US012256790B2

(12) United States Patent
Axelsson

(10) Patent No.: US 12,256,790 B2
(45) Date of Patent: Mar. 25, 2025

(54) SEALING ARRANGEMENT FOR A GARMENT

(71) Applicant: SI TECH AB, Brastad (SE)

(72) Inventor: Jonas Axelsson, Brastad (SE)

(73) Assignee: SI TECH AB, Brastad (SE)

( * ) Notice: Subject to any disclaimer, the term of this patent is extended or adjusted under 35 U.S.C. 154(b) by 122 days.

(21) Appl. No.: 17/626,159

(22) PCT Filed: Jul. 10, 2020

(86) PCT No.: PCT/EP2020/069616
§ 371 (c)(1),
(2) Date: Jan. 11, 2022

(87) PCT Pub. No.: WO2021/009064
PCT Pub. Date: Jan. 21, 2021

(65) Prior Publication Data

US 2022/0240601 A1 Aug. 4, 2022

(30) Foreign Application Priority Data

Jul. 12, 2019 (SE) ..... 1950887-8

(51) Int. Cl.
*A41D 13/00* (2006.01)
*A44B 19/32* (2006.01)

(52) U.S. Cl.
CPC ..... *A41D 13/0005* (2013.01); *A44B 19/32* (2013.01)

(58) Field of Classification Search
CPC ..... A41D 13/0005; A41D 19/0089; A41D 19/0041
See application file for complete search history.

(56) References Cited

U.S. PATENT DOCUMENTS 2,107,216 A 2/1938 Rogers
2,355,816 A 8/1944 Georg
(Continued)

FOREIGN PATENT DOCUMENTS

FR 807192 A 1/1937
GB 2555405 A 5/2018
(Continued)

OTHER PUBLICATIONS

PCT International Search Report and Written Opinion dated Sep. 24, 2020 for International Application No. PCT/EP2020/069616, 14 pages.

(Continued)

*Primary Examiner* — Alissa L Hoey
(74) *Attorney, Agent, or Firm* — RMCK Law Group, PLC

(57) ABSTRACT

The present disclosure relates to a reclosable sealing arrangement for a garment, comprising inter-connectable first tubular portion and second tubular portion for encircling a body portion of a user, a releasable connection system having a first annular connection member extending circumferentially around the first tubular portion and a second annular connection member extending circumferentially around the second tubular portion, whereby the releasable connection system is configured to interconnect said first tubular portion with said second tubular portion, and wherein the reclosable sealing arrangement further comprises a first annular seal member extending circumferentially around the first tubular portion and a second annular seal member extending circumferentially around the second tubular portion to form a fluid-tight seal configuration for the releasable connection system when said first annular connection member is inter-connected to said second annular connection member.

17 Claims, 7 Drawing Sheets

(56) References Cited

U.S. PATENT DOCUMENTS

| | | | | |
|---|---|---|---|---|
| 2,454,214 | A | 11/1948 | Sapp | |
| 2,637,086 | A | 5/1953 | David | |
| 2,746,114 | A | 5/1956 | Williams | |
| 2,853,758 | A | 9/1958 | Topf | |
| 3,000,014 | A * | 9/1961 | White | B64D 10/00 285/260 |
| 3,417,406 | A | 12/1968 | Rosenbaum | |
| 4,941,238 | A * | 7/1990 | Clark | A44B 19/32 24/584.1 |
| 4,987,657 | A * | 1/1991 | Moreland | E04H 4/10 24/389 |
| 6,223,349 | B1 * | 5/2001 | Roiser | A44B 19/32 2/82 |
| 7,051,374 | B1 * | 5/2006 | Grilliot | A41F 1/002 2/69 |
| 7,195,025 | B2 * | 3/2007 | Choi | E04H 15/32 135/117 |
| 7,496,992 | B2 * | 3/2009 | Ausnit | B65D 33/2541 24/30.5 R |
| 8,028,351 | B2 * | 10/2011 | Stachler | A62B 17/006 2/457 |
| 8,327,464 | B2 * | 12/2012 | Jaros | A41F 1/00 2/243.1 |
| 11,180,286 | B2 * | 11/2021 | Pawloski | B65D 33/255 |
| 2006/0112523 | A1 * | 6/2006 | Deto | A41F 1/002 24/303 |
| 2007/0277353 | A1 * | 12/2007 | Kondo | A45C 13/1069 24/303 |
| 2016/0198782 | A1 | 7/2016 | Thompson | |
| 2019/0274375 | A1 * | 9/2019 | Brown | B63C 11/04 |
| 2021/0196007 | A1 * | 7/2021 | Haugen | A41D 13/0005 |
| 2021/0196009 | A1 * | 7/2021 | Haugen | A41D 13/0005 |
| 2022/0063781 | A1 * | 3/2022 | Letoshi | A41D 13/0005 |

FOREIGN PATENT DOCUMENTS

| | | | |
|---|---|---|---|
| WO | 9923902 | A1 | 5/1999 |
| WO | 2017060467 | A1 | 4/2017 |

OTHER PUBLICATIONS

Swedish Office Action and Search Report dated Mar. 12, 2020 for Swedish Patent Application No. SE1950887-8, 8 pages.

* cited by examiner

SEALING ARRANGEMENT FOR A GARMENT

CROSS-REFERENCE TO RELATED APPLICATIONS

This application is a 371 U.S. National Stage of International Application No. PCT/EP2020/069616, filed Jul. 10, 2020, which claims priority to Swedish Patent Application No. 1950887-8, filed Jul. 12, 2019. The disclosures of each of the above applications are incorporated herein by reference in their entirety.

TECHNICAL FIELD

The present disclosure relates to a reclosable annular sealing arrangement for a garment. The disclosure also relates to a garment comprising such reclosable sealing arrangement. In particular, the reclosable sealing arrangement comprises means for inter-connecting two tubular portions and means for providing a fluid-tight sealing, including e.g. a liquid-tight sealing, such as a water-tight sealing, or a gas-tight sealing, such as an air-tight sealing.

The present disclosure can be applied to garments such as garments for weather protection, fluid-protective garments, such as waterproof garments, water-resistant garments, diving suits, dry suits, protection suits, wet suits, work wear, and other clothing for sport and leisure. Although the disclosure will be described with respect to a diving suit, the disclosure is not restricted to this particular garment, but may also be used in other fluid-protective garments and light-weight garments such as e.g. waterproof jackets and/or waterproof pants, and garments which may be subject to high external forces such as e.g. off-shore applications.

BACKGROUND

In the field of garments, such as protective garments, e.g. dry suits and diving suits, there are a number of solutions relating to sealing arrangements for sealing a wearer of the garment, or certain parts of the wearer, from e.g. a fluid such as water or contaminated air/gas. By way of example, in a diving suit, the garment around the neck may need to be sealingly connected to a diving cap or diving helmet in order to provide suitable sealing for the wearer from the surroundings when diving. Similarly, the feet and hands of the wearer, i.e. the garment around the wrists and cuffs of the diving suit, may need to be sealingly connected to diving gloves and diving boots, respectively. In other situations, an outdoor worker may want to stay dry during inclement weather, and may thus often use a wearable water-resistant garment to prevent rain from entering through the garments and in-between layers of garments. Similar to the example for diving suits, not only the rain boots may need to provide a water-tight connection with the rain trousers, but also rain gloves may need to be sealingly connected to the rain jacket. Thus, for many applications, there is a need to sealingly connect a wearable layer or a portion of a garment, e.g. the glove of a work wear garment, the neck of a diving suit or portions around the waist line, to another wearable layer of the garment, e.g. a diving cap/helmet, a rain jacket or a pair of rain trousers, respectively.

WO 2017/060467 discloses one type of garment for a wearer, in which the garment such as a diving suit comprises a number of sealing arrangement. By way of example, a cuff portion of the diving suit has a sealing arrangement with a sealing device and a reinforcement clip. The sealing device is provided with an annular sealing body adapted to be locked into a recess to sealingly connect a wearable layer between an annular base and the annular sealing body. Further, the reinforcement clip is arranged to be locked to the sealing device.

While there are a number of different garments to be used in a wet environment in order to keep a wearer dry by being waterproof and/or water repellent, there is still an increasing demand for sealingly connect parts of such garments in an appropriate and comfortable manner.

SUMMARY OF THE DISCLOSURE

An object of the disclosure is to provide a user-friendly, yet reliable, annular sealing arrangement for a garment, in which tubular portions can be inter-connected to each other in a manner so as to reduce the load-bearing requirements on the fluid-tight seal of the sealing arrangement.

According to a first aspect of the disclosure, this object is at least partly achieved by the features of claim 1. According to a second aspect of the disclosure, the object is at least partly achieved by the features of claim 12. According to a third aspect of the disclosure, the object is at least partly achieved by the features of claim 17.

According to the first aspect thereof, the object is achieved by a reclosable sealing arrangement for a garment, defining inter-connectable first tubular portion and second tubular portion for encircling a body portion of a user, and comprising a releasable connection system having a first annular connection member extending circumferentially around the first tubular portion and a second annular connection member extending circumferentially around the second tubular portion. Thereby, the releasable connection system is configured to inter-connect the first tubular portion with the second tubular portion. Further, the reclosable sealing arrangement comprises a first annular seal member extending circumferentially around the first tubular portion and a second annular seal member extending circumferentially around the second tubular portion to form a fluid-tight seal configuration for the releasable connection system when the first annular connection member is inter-connected to the second annular connection member.

In other words, the sealing arrangement provides for connecting separate first and second tubular portions of a garment by means of the releasable connection system, while providing sealing against an outside fluid by means of the arrangement of the first annular seal member and second annular seal member in a connected state of the releasable connection system. As such, the sealing arrangement provides separately arranged means for connecting the tubular portions and separately arranged means for sealing against fluids, such as water on the outside of the sealing arrangement. That is, the releasable connection system for circumferentially connecting disengagable tubular portions are arranged/provided separately from the annular seal members for sealing from fluid in the interface between the tubular portions. In this manner, the example embodiments provide for an improved sealing arrangement, in which the annular connection members making-up the reclosable connection system are the primary load-bearing or load-transferring parts for handling forces being generated during use of the garment, thus allowing for a more simple fluid-tight seal configuration with low or no requirements to withstand forces generated during use of the garment. Such reclosable sealing arrangements thus allows for using a somewhat weaker fluid-tight seal structure compared to other prior art seals where the prior art seals may also need to be load-transferring seals. Accordingly, the reclosable sealing arrangement provides for circumferentially connecting and sealing the first tubular portion with the second tubular portion in an easy, yet reliable manner.

In particular, the releasable connection system of the sealing arrangement provides for maintaining the first tubular portion and the second tubular portion in a closed configuration when the portions are connected to each other, i.e. a connected configuration so as to permit the sealing arrangement to withstand any tensile forces generated under ordinary use of the garment by a wearer, whilst enabling complete separation of the portions when the releasable connection system is in a released state, in which the first and second tubular portions are released from each other. In this context, the released state may also likewise be referred to as a disengaged state or separated state. The releasable connection system forms a mechanically closed and connected configuration by interconnecting the first annular connection member with the second annular connection member. Hence, in the connected state, i.e. in a state where the releasable connection system connects the first tubular portion to the second tubular portion, the sealing arrangement can withstand a relatively high external force without losing its sealing properties (as provided by the annular sealing members), i.e. without having the annular sealing members released from each other. Further, in the connected state, the annular sealing members forms the fluid-tight seal configuration. In a disconnected state, when the first annular connection member is released from the second annular connection member, the first tubular portion can be disconnected from the second tubular portion.

More specifically, by the provision of having a releasable connection system configured to circumferentially connect the first tubular portion with the second tubular portion, there is formed a connected configuration so as to prevent, or at least substantially reduce, generation of relative movement between the first tubular portion and the second tubular portion in the connected state of the reclosable sealing arrangement. In this context, the term "relative movement" generally refers to a relative movement in a height direction (i.e. axial direction) of the reclosable sealing arrangement. The height direction refers to the height direction as defined with conventional cylindrical coordinates.

To this end, the sealing arrangement provides for an easy connection of the first tubular portion to the second tubular portion by the reclosable connection system, while providing great sealing properties thanks to the configuration of the connection system in combination with the annular seal members. In this manner, the sealing arrangement according to the example embodiments provides for a reliable (typically a mechanical or magnetically) connection between annular portions of the garment as well as a reliable fluid-tight connection between the annular portions of the garment during use thereof. In addition, the provision of the releasable connection system may facilitate the process of sealingly connecting the annular sealing member of the first tubular portion to the annular sealing member of the second tubular portion by providing a pulling force on each one of the annular sealing members, respectively, so as to positioning them in the fluid-tight seal configuration when circumferentially closing the annular connection members of the reclosable connection system.

By the configuration of the reclosable sealing arrangement, the connected state of the first tubular portion and the second tubular portion is provided by inter-connecting the first annular connection member with the second annular connection member along the circumferential direction of the first tubular portion and the second tubular portion. This allows for a more intuitive and user-friendly way of connecting e.g. a glove with an arm of a dry suit, as compared to known prior art connections.

The reclosable sealing arrangement according to the example embodiments, in particular tubular portions thereof, are particularly suited for encircling a portion of a limb, a portion of the torso (a portion of a upper body part), a portion of the neck of a user in order to provide a fluid-tight seal configuration at the sealing arrangement, e.g. for use as parts of a diving suit, dry suit, work wear or the like. The example embodiments of the sealing arrangement can be used in several different types of garments, including, but not limited to garments for weather protection, fluid-protective garments, such as waterproof garments, water-resistant garments, diving suits, dry suits, protection suits, wet suits, work wear, and other clothing for sport and leisure (e.g. waders and fishing garment suits). The example embodiments of the sealing arrangement may typically also be used for relatively light-weight garments such as e.g. waterproof jackets, and/or to garments which may be subject to high external forces such as e.g. off-shore applications.

Typically, as mentioned above, the reclosable sealing arrangement should be designed to be flexible or bendable enough to facilitate connection of the components of the sealing arrangement. Thus, the components of the sealing arrangement are generally provided in materials having relatively high bendable properties so as to provide for a comfortable use when incorporated in a garment such as diving suit, dry suit, work wear or the like.

The fluid-tight seal configuration may generally be arranged along an inner circumferential side (of the reclosable sealing arrangement) facing the user during use of the sealing arrangement. However, in some example embodiments, the fluid-tight seal configuration may be arranged along an outer circumferential side (of the reclosable sealing arrangement) facing away from the user during use of the sealing arrangement. The fluid-tight seal configuration can be obtained by several different types of annular seal members and by several different arrangements of the annular seal members, as further described herein.

Typically, a portion of the first annular seal member is arranged in contact with a portion of the second annular seal member to form the fluid-tight seal configuration when the first annular connection member is circumferentially interconnected to the second annular connection member. By way of example, when the first annular connection member is circumferentially inter-connected to the second annular connection member, the first annular seal member and the second annular seal member cover at least the connection between the first annular connection member and the second annular connection member in a circumferential direction and in the height direction.

According to one example embodiment, the first annular connection member and the second annular connection member are arranged relative the first annular seal member and the second annular seal member, respectively, such that inter-connecting the first annular connection member with the second annular connection member along the circumferential direction brings the first annular seal member in contact with the second annular seal member along the circumferential direction. In this manner, the fluid-tight seal configuration is mutually formed along the circumferential direction when circumferentially inter-connecting the first annular connection member with the second annular connection member. In this manner, there is provided an arrangement of the first annular connection member and the second annular connection member that allows for securing an accurate fluid-tight seal configuration, i.e. the releasable connection system is hereby configured to facilitate in the sequence of accurately positioning the annular seal members in the fluid-tight configuration when forming the connection between the first annular connection member and the second annular connection member along the circumferential direction of the reclosable sealing arrangement.

According to one example embodiment, the first annular seal member and the second annular seal member are arranged in a partly overlapping fluid-tight seal configuration when the first annular connection member is circumferentially inter-connected to the second annular connection member. In this manner, there is provided an even more reliable fluid-tight configuration for the reclosable sealing arrangement. According to one example embodiment, the first annular seal member and the second annular seal member are arranged in a fully overlapping fluid-tight seal configuration when the first annular connection member is circumferentially inter-connected to the second annular connection member. While not strictly necessary, the first annular seal member and the second annular seal member may typically at least overlap each other to such an extent that the reclosable sealing arrangement can prevent fluid from entering though the components of the reclosable sealing arrangement to the body part of wearer, in particular through the components of the releasable connection system. Typically, the first annular seal member and the second annular seal member overlap each other in the circumferential direction of the reclosable sealing arrangement. Typically, the first annular seal member and the second annular seal member overlap each other in the height direction of the reclosable sealing arrangement.

According to one example embodiment, one of the first annular seal member and the second annular seal member comprises an annular recess for accommodating an annular portion of the other one of the first annular seal member and the second annular seal member. In this configuration, the fluid-tight configuration is formed when the annular recess accommodates the annular portion circumferentially around the sealing arrangement. In this manner, there is provided an improved arrangement of the fluid-tight configuration in that the annular recess contributes to further maintain the annular seal members closer to each other, which is particularly useful if the sealing arrangement is subject to heavy external forces in different directions. Accordingly, the sealing arrangement can withstand an even higher external force without losing its sealing properties, i.e. without having one of the annular seal members being released from the recess, as the annular recess provides a holding and retaining of the portion in the recess. According to one example embodiment, the annular recess and the annular portion are complementary shaped portions. The complementary shapes of the annular portion and the annular recess contribute to an improved positioning of the first annular seal member and the second annular seal member when inter-connecting the tubular portions with each other.

By way of example, the annular portion of the annular seal member is an outer edge portion of the other one of the first annular seal member and the second annular seal member. One advantage with arranging the annular portion on an outer edge portion of an annular seal member is that the positioning of the annular seal members when closing the releasable connection system is improved. According to one example embodiment, the annular portion is an annular rib portion. In this manner, the positioning of the annular seal members when closing the releasable connection system is further improved. Such configuration also increases engagement between the annular seal members and may be particularly useful for garments used during extreme conditions. By way of example, the annular rib portion is arranged on the outer edge portion. That is, the other one of the first annular seal member and the second annular seal member comprises an annular rib portion arranged on an outer edge thereof. The annular rib portion is typically a projecting portion of the annular seal member. The annular rib portion may have a different shape and dimension compared to the other part(s) of the annular seal member. In other example embodiments, the outer edge portion of the seal member may resemble any one of a circle, an ellipse, a rectangle, a triangle or any other type of geometrical shaped portion as long as the annular portion of the annular seal member can be accommodated in the corresponding shape of the annular recess of the other annular seal member to form the fluid-tight seal configuration when the first annular connection member is circumferentially connected to the second annular connection member.

Typically, although strictly not required, when the first annular connection member is circumferentially connected to the second annular connection member and the annular portion of the annular seal member is accommodated in the annular recess of the other annular seal member, an outer surface of the annular rib portion abuts or contacts an inner surface of the annular recess.

The annular recess can be arranged in several different manners. In addition, the annular recess may be provided in several different shapes. In one example, the annular recess resembles a circle, an ellipse, a rectangle, a triangle or any other geometrical shape suitable for accommodating another portion of the second annular seal member. More specifically, the annular recess generally resembles a truncated circle, a truncated ellipse, a truncated rectangle, a truncated triangle or any other truncated geometrical shape suitable for accommodating another portion of the second annular seal member. In the context of the shape of the annular recess, the shape, e.g. the truncated circle, refers to the shape of the annular recess in a cross-sectional view extending in a radial direction and the height direction of the sealing arrangement.

According to one example embodiment, the first annular seal member comprises an elongated stem portion and opposite extending flanges thereof. By way of example, portions of the opposite extending flanges may define the shape of the annular recess, such as a truncated circle. Hence, the annular recess may at least partly be defined by the stem portion and the flanges extending from the stem portion.

Analogously, the second annular seal member may comprise an elongated stem portion. In an example where the second annular seal member is provided with an annular rib portion, the annular rib portion typically extends from the elongated stem portion.

Typically, although not strictly required, each one of the stem portions of the first and second annular seal members, respectively, are attached to the corresponding first and second tubular portions, respectively. Alternatively, or in addition, each one of the stem portions of the first and second annular seal members, respectively, are attached to the first and second annular connection members, respectively.

According to one example embodiment, the annular portion has an indentation for engaging with an edge of the annular recess. The indentation is arranged to form a lip or shoulder with an outer surface of the annular portion. In this manner, the fluid-tight seal configuration of the annular seal members is further improved. According to one example embodiment, the annular recess defines plurality of protrusions distributed along a surface of the annular seal member defining the recess. The protrusions are arranged to engage with a corresponding outer surface of the annular portion. In this manner, the fluid-tight seal configuration of the annular seal members is further improved.

According to one example embodiment, the annular recess and the annular rib portion are complementary shaped portions. In this manner, there is provided a configuration whereby the positioning of the annular seal members when closing the releasable connection system is improved in terms of intuitiveness and correctness. Moreover, the fluid-tight seal configuration is further improved in terms of security against leakage because there is less risk that the sealing components disengage during use thereof. As such, the sealing arrangement can withstand an even higher external force without losing its sealing properties, i.e. without having the annular portion of the annular seal member being released from the recess, as the complementary shapes of the rib portion and the recess allows for a firm holding and retaining of the rib portion in the recess.

In other words, according to one example embodiment, one of the first annular seal member and the second annular seal member comprises an annular rib portion and the other one of the first annular seal member and the second annular seal member comprises a complementary annular recess for accommodating the annular rib portion.

According to one example embodiment, the annular recess and the annular rib portion are arranged relative the first annular connection member and the second annular connection member, respectively, such that the annular recess accommodates the annular rib portion when the first annular connection member is circumferentially inter-connected to the second annular connection member.

Typically, the annular recess extends along an entire annular length of the corresponding annular seal member. Analogously, the annular rib portion typically extends along an entire annular length of the other corresponding annular seal member.

According to one example embodiment, the first annular connection member is at least partly superposed the first annular seal member in the radial direction and the second annular connection member is at least partly superposed the second annular seal member in the radial direction.

According to one example embodiment, the first annular connection member and the first annular seal member are disposed on radially opposite sides of the first tubular portion, and the second annular connection member and the second annular seal member are disposed on corresponding radially opposite sides of the second tubular portion, respectively.

The reclosable sealing arrangement may generally have an inner surface facing the user during use and an outer surface facing away from the user during use. Hence, the first tubular portion may typically have an inner surface facing the user during use and an outer surface facing away from the user during use. Analogously, the second tubular portion may generally have an inner surface facing the user during use and an outer surface facing away from the user during use.

Further, according to one example embodiment, an outer circumferential edge portion of the first tubular portion is adapted to be interconnected to an outer circumferential edge portion of the second tubular portion by the first and second annular connection members.

According to one example embodiment, the first annular connection member is attached to an outer surface of the first annular seal member and the second annular connection member is attached to an outer surface of the second annular seal member.

According to one example embodiment, the releasable connection system is arranged along an outer circumferential side facing away from the body portion of the user during use of the reclosable sealing arrangement and the fluid-tight seal configuration is arranged along an inner circumferential side facing the user during use of the reclosable sealing arrangement.

According to another example embodiment, the fluid-tight seal configuration is arranged along the outer circumferential side facing away from the body portion of the user during use of the reclosable sealing arrangement and the releasable connection system is arranged along the inner circumferential side facing the user during use of the reclosable sealing arrangement.

As mentioned above, the releasable connection system is provided separately from the sealing configuration of the reclosable sealing arrangement. Hence, the first annular seal member and the first annular connection member are typically separate parts of the first tubular portion. That is, the first annular seal member and the first annular connection member are individual parts of the first tubular portion. Analogously, the second annular seal member and the second annular connection member are typically separate parts of the second tubular portion. That is, the second annular seal member and the second annular connection member are individual parts of the second tubular portion. However, the components making up the reclosable sealing arrangement can be provided and arranged in several different ways. According to one example embodiment, the first tubular portion comprises the first annular connection member and the first annular seal member, and the second tubular portion comprises the second annular connection member and the second annular seal member. More specifically, the first tubular portion may comprise the first annular connection member. Analogously, the second tubular portion may comprise the second annular connection member. In addition, the first tubular portion may comprise the first annular seal member. Analogously, the second tubular portion may comprise the second annular seal member.

According to one example embodiment, the first tubular portion consists of the first annular connection member and the first annular seal member. Analogously, the second tubular portion consists of the second annular connection member and the second annular seal member. According to one example embodiment, the first annular connection member and the first annular seal member constitutes the first tubular portion. Analogously, the second annular connection member and the second annular seal member constitutes the second tubular portion.

Moreover, by way of example, the releasable connection system may be arranged on the outside of the sealing arrangement. Typically, the first annular connection member may be arranged on an outer surface of the first annular seal member, and the second annular connection member may be arranged on an outer surface of the second annular seal member, respectively. Such arrangement is particularly useful for dry suits and diving suits. Alternatively, the releasable connection system may be arranged on the inside of the sealing arrangement, while the fluid-tight seal configuration is arranged on the outside of the sealing arrangement. Typically, the first annular connection member may be arranged on an inner surface of the first annular seal member, and the second annular connection member may be arranged on an inner surface of the second annular seal member, respectively. Such arrangement of the fluid-tight seal configuration on the outside of the sealing arrangement, i.e. on the outside of the garment facing the body, is particularly useful for protective suits intended for chemical applications.

The first annular connection member may be directly attached to the first annular seal member and the second annular connection member may be directly attached to the second annular seal member. Typically, the first annular connection member may be attached to the first annular seal member without any additional intermediate layers of materials and the second annular connection member may be attached to the second annular seal member without any additional intermediate layers of materials.

According to one example embodiment, the first tubular portion is a portion of a garment material, wherein the first annular connection member and the first annular seal member are attached to opposite sides of the portion of the garment material. Analogously, the second tubular portion is another portion of a garment material, wherein the second annular connection member and the second annular seal member are attached to opposite sides of the other portion of the garment material.

Typically, each one of the components of the sealing arrangement may be circumferentially attached to another component by adhesive means, welding, moulding, casting, and/or laces. According to one example embodiment, the first annular connection member is attached to the outer surface of the first tubular portion. By way of example, the first annular connection member is attached to the outer circumferential edge portion of the first tubular portion. Thus, the first annular connection member is an integral part of the outer circumferential edge portion of the first tubular portion. Analogously, the second annular connection member is attached to the outer surface of the second tubular portion. The second annular connection member is attached to the outer circumferential edge portion of the second tubular portion. Thus, the second annular connection member is an integral part of the outer circumferential edge portion of the second tubular portion. The first annular seal member is attached to the inner surface of the first tubular portion. By way of example, the first annular seal member is attached to an inner circumferential edge portion of the first tubular portion. Hence, the first annular seal member is an integral part of the inner circumferential edge portion of the first tubular portion. The second annular seal member is attached to the inner surface of the second tubular portion. The second annular seal member is attached to an inner circumferential edge portion of the second tubular portion. Hence, the second annular seal member is an integral part of the inner circumferential edge portion of the second tubular portion.

The releasable connection system can be provided in several different manners. The first annular connection member may generally include an annular engagement element adapted to inter-connect with an annular engagement element of the second annular connection member. Hence, the second annular connection member may generally include an annular engagement element adapted to inter-connect with an annular engagement element of the first annular connection member. By way of example, the releasable connection system is a releasable mechanical connection system. As such, the first and second annular connection members comprises a first mechanical connector structure and a second mechanical connector structure, respectively, that are mechanically connectable to form the connected state of the releasable connection system.

One example of a mechanical connection system is a zipper. Accordingly, in one example embodiment, the releasable connection system is a zipper, wherein the first annular connection member is a first half of the zipper and the second annular connection member is a second half of the zipper. By using a circumferentially extending zipper as a releasable connection system, there is provided an easy-to-use connection system that also allows for reducing the force necessary to connect the annular connection members with each other, thus reducing the force needed to close the sealing arrangement about the body portion of the user. The term "zipper" as used herein includes mechanical connection devices comprising two zipper-tape halves, each one provided with teeth or other elements including (e.g. male and/or female) interlocking profiles, which can interlock together or disengaged from another via the use of a slider to form a closed or opened zipper chain, respectively. For convenience in use, it may be desirable that the zipper is accessible for actuation from the outside of the reclosable sealing arrangement. Favorably, the zipper may be a separating-type zipper. When the zipper is closed, the reclosable sealing arrangement is substantially cylindrical in shape. The zipper may be made of a material suitable for wet environments. By way of example, the zipper may be made of metal, plastics or any other suitable material for the purpose of the garment. Hence, the zipper may be any one of a metal open end zipper, a plastic open-end zipper and a coil open end zippers.

Typically, although strictly not required, the zipper comprises a slider slidably coupled to the opposing zipper halves. The slider is operable to releasably connect the opposing zipper halves to each other. By way of example, the slider of the zipper comprises an elongate tab member having a first end pivotally coupled to the slider. In this manner, the opposing zipper halves are engaged to each other in easy manner around the circumferential direction of the sealing arrangement. Generally, the slider is mounted on the annular first half of the zipper and the annular second half of the zipper for movement along the zipper halves to close the same together to effect an annular closure between the first and second tubular portions. In other words, the slider is arranged on the releasable connection system to function as a slidable annular closure element.

According to one example embodiment, the first half of the zipper and the second half of the zipper are arranged relative the annular recess and the annular portion, respectively, such that the annular recess accommodates the annular portion when the first half of the zipper is circumferentially inter-connected to the second half of the zipper. In one example, when the annular portion is an annular rib portion of an outer edge on the corresponding annular connection member, the first half of the zipper is arranged relative the annular recess on the first tubular portion, and the second half of the zipper is arranged relative the annular rib portion on the second tubular portion, respectively, such that the annular recess accommodates the annular rib portion when the first half of the zipper is circumferentially inter-connected to the second half of the zipper.

According to another example embodiment the releasable connection system is a magnetically configured connection system. By way of example, the first annular connection member comprises a first magnetic material and the second annular connection member comprises a second magnetic material, the first magnetic material and the second magnetic material being adapted to attract each other so as to form the releasable connection system. Typically, any one of the first and second magnetic material is made of a flexible magnetic material. By way of example the flexible magnetic material is a flexible magnetic material strip. The type of magnetic material is generally selected in view of the intended use of the garment so as to ensure a reliable connection system for ordinary use of the garment in its intended environment.

The annular shape of the sealing arrangement and its various parts are to be understood as ring-shaped, i.e. as formed/shaped around an origin. In other words, the annular shape of the tubular portions, the annular connection members and the annular seal members are generally ring-shaped. The annular shape may e.g. be circular, essentially circular, oval, elliptical or formed in any other annular form. Thus, the sealing arrangement may be formed to fit around a portion of a body e.g. the waste of a human, limbs of a human, such as e.g. the neck, arms, hands, legs and wrists of a human.

The sealing arrangement has an extension in the circumferential direction. It should also be understood that the sealing arrangement, and its related parts, e.g. the annular seal members, the annular connection members and the tubular portions, generally have an extension in the circumferential direction, i.e. in a direction around a periphery of the sealing arrangement, and an extension in the radial direction, i.e. in a direction perpendicular to the circumferential direction and directing from an inner annular surface of the sealing arrangement towards an outer annular surface of the sealing arrangement. In other words, the sealing arrangement, and its parts, may be described with cylindrical coordinates (C, R, Z), the circumferential direction corresponding to the direction of the angle C of the angular coordinate C, the radial direction corresponding to a direction in the radial distance R, and the direction perpendicular to both the circumferential direction and the radial direction corresponding to a direction along the height Z.

The releasable connection system typically extends along the circumferential direction of the sealing arrangement when the first annular connection member and second annular connection member are connected to each other. More specifically, the releasable connection system may extend in a continuous manner along the circumferential direction of the sealing arrangement when the first annular connection member and second annular connection member are connected to each other.

It should be understood that the first annular connection member and the second annular connection member are adapted to connect to each other along the entire circumference of the sealing arrangement. In addition, it should be understood that the first annular seal member and the second annular seal member are generally arranged to be sealed to each other along the entire circumference of the sealing arrangement in order to seal the body part of the user from its surroundings.

When the first annular connection member and second annular connection member are connected to each other, the releasable connection system typically extends from a circumferential starting point to a circumferential end point. By way of example, the circumferential distance between the circumferential starting point and the circumferential end point is less than 10 degrees, as seen in the circumferential direction and when the first annular connection member and the second annular connection member are connected to each other. Still preferably, the circumferential distance between the circumferential starting point and the circumferential end point is less than 5 degrees, as seen in the circumferential direction and when the first annular connection member and the second annular connection member are connected to each other. Still preferably, the circumferential starting point and the circumferential end point are arranged essential at the same circumferential position, as seen in the circumferential direction and when the first annular connection member and the second annular connection member are connected to each other. In the example embodiment when the releasable connection system is a zipper, and the first annular connection member corresponds to the first half of the zipper and second annular connection member corresponds to the second half of the zipper, the zipper box typically corresponds to the circumferential starting point and the zipper stopper typically corresponds to the circumferential end point.

The reclosable sealing arrangement, in particular the main part of the reclosable sealing arrangement, favorably comprises a material that is suitable for use in garments subjected to constant humidity, water or a gas pressure. Such materials are known in the art. Favorably such materials are stretchable, so that they can readily adapt to the shape of the relevant body part (e.g. leg, arm, wrist, neck, etc.). Thus, according to one example embodiment, the reclosable sealing arrangement is a flexible reclosable sealing arrangement, wherein at least the first and second annular seal members are first and second flexible annular seal members, respectively. By way of example, the first and second annular seal members can be made from a flexible material e.g. plastic such as thermoplastic polyurethane (TPU), polyurethane, or rubber or silicone. The material should typically be selected based on the purpose of the fluid-tight seal configuration and the type of garment. Thus, according to at least one example embodiment, each one of the components of the sealing arrangement may comprise a flexible material e.g. plastic such as thermoplastic polyurethane (TPU), polyurethane, or rubber or silicone. By way of example, if the reclosable connection system is a zipper, each one of the first annular connection member and the second annular connection member may be made from a plastic material or metal. One suitable material for the zipper is brass. However, the zipper may in other example embodiments be made from a plastic. Another example of a suitable zipper is a so-called coil zipper, also known as nylon coil zipper. A coil zipper is a type of zipper whose teeth/elements are made from coiled monofilament that is traditionally nylon. The coil is sewn to a zipper tape to form the first and second annular connection members of the reclosable connection system. However, the material of the reclosable connection system should typically be selected based on the type of garment. Further, the first tubular portion and the second tubular portion may either be a garment material or made from any one of the materials of the reclosable connection system and the seal member material depending on the type of structure of the sealing arrangement, as described herein.

According to at least one example embodiment, each one of the annular seal members of the sealing arrangement is moulded, e.g. injection-moulded or casted. Analogously, each one of the tubular portions may be moulded, e.g. injection-moulded or casted.

In the context of the present disclosure, the term "fluid" in the term fluid-tight seal configuration may refer to any type of fluid, including, but not limited to liquid fluids and gaseous fluids. By way of example, the liquid fluid is water. One example of a gaseous fluid is water vapor. Another example of a gaseous fluid is air. It is to be noted that the fluid-tight seal configuration refers to a configuration between the first and second annular seal members that seals against fluid at least when the first annular connection member is connected to the second annular connection member. In one example embodiment, the fluid-tight seal configuration seals at least against any one of liquid fluids and gaseous fluids. In another example embodiment, the fluid-tight seal configuration seals at least against any one of water and water vapor. In yet another example embodiment, the fluid-tight seal configuration seals at least against any one of water, water vapor and air. In still another example embodiment, the fluid-tight seal configuration seals at least against air.

According to one example embodiment, the releasable connection system is a first releasable connection system and the sealing arrangement further comprises a second releasable connection system. The second releasable connector system has corresponding first annular connection member and second annular connection member. Further, the first releasable connector system and the second releasable connector system are arranged on radial opposite sides of the first and second annular seal members. In one example embodiment, the first annular connection member of the second releasable connector system is arranged to the inner surface of the first annular seal member and the second annular connection member of the second releasable connector system is arranged on the inner surface of the second annular seal member. Typically, the first annular connection member of the first releasable connection system is arranged to the outer surface of the first tubular portion, while the second annular connection member of the first releasable connection system is arranged to the outer surface of the second tubular portion. Moreover, the second releasable connection system has a corresponding first annular connection member extending circumferentially around the inner surface of the first tubular portion and a corresponding second annular connection member extending circumferentially around the inner surface of the second tubular portion. Moreover, the second releasable connection system is configured to circumferentially connect its first tubular portion with its second tubular portion. Hence, the second releasable connection system is arranged on the inner surface of the sealing arrangement. A configuration with a first releasable connection system and a second releasable connection system is particularly useful for a sealing arrangement in connection with one of interfaces between a pair of trousers and a pair of boots. By connecting a pair of boots to a pair of trousers by means of a two-system approach provides for an improved secure connection arrangement having a smooth inner surface against the body of the wearer. That is, the annular seal members are covered by the second releasable connection system such that no contact may occur between the body and the annular seal members.

The sealing arrangement may be used to connect two portions of a garment, such as two tubular wearable layers of the garment to each other. For example, the neck portion of a jacket or diving suit may be sealingly connected to an annular surface of a helmet, the neck portion including the tubular portion. It is to be noted that each one of the first and second tubular portions may be separate portions of the sealing arrangement of the garment. In addition, or alternatively, each one of the first and second tubular portions may be integral portions of the sealing arrangement, wherein each one of the first and second tubular portions of the sealing arrangement extends into a first and second garment portions of the garment, respectively. Alternatively, each one of the first and second tubular portions may be separate portions of the sealing arrangement, wherein each one of the first and second tubular portions are fixedly attached to first and second garment portions, respectively, of the garment. In all these example, the reclosable sealing arrangement provides for sealingly and circumferentially connecting the first tubular portion of a garment with a second tubular portion (of the garment) in an easy, yet reliable manner. The first tubular portion and the second tubular portion are typically separable parts of the garments. However, the sealing arrangement for garments should be understood to at least include the use of one of the tubular portions to connect to a portion of the garment by means of the sealing arrangement. Accordingly, it should be readily appreciated that the sealing arrangement is generally a portion of a garment.

The object of the present disclosure is also at least partly achieved by the features of a garment according to the second aspect of the disclosure. Hence, according to the second aspect of the disclosure, there is provided a fluid-protective garment, such as a waterproof garment, a water-resistant garment, a diving suit, a dry suit, a protection suit, a wet suit or a work wear, comprising a reclosable sealing arrangement according to any one of the example embodiments relating to the first aspect of the disclosure. As mentioned above, the first and second tubular portions of the sealing arrangement may correspond to first and second tubular portions of the garment, respectively. In other example embodiments, wherein the first and second annular connection members and the first and second annular seal members are attached to each other, the first and second annular connection members may be directly attached to the first and second tubular portions of the garment, respectively. In addition, or alternatively, in other example embodiments, wherein the first and second annular connection members and the first and second annular seal members are attached to each other, the first and second annular seal members may be directly attached to the first and second tubular portions of the garment, respectively. Thus, in some example embodiments, the first annular connection member and the first annular seal member may be integral parts of a first tubular portion of a garment, while the second annular connection member and the second annular seal member may be integral parts of a second tubular portion of a garment. In other example embodiments, the first annular connection member and the first annular seal member may be attached to each other and further attached to a first tubular portion of a garment, while the second annular connection member and the second annular seal member may be attached to each other and further attached to a second tubular portion of a garment. In this context of the disclosure, the term attached may refer to attachment by adhesive, ultra-sonic bonding or any other type of permanent attachment of a part to another part. In this context of the disclosure, the term directly attached may refer to attachment without any intermediate layer therebetween. Also, direct attachment may be performed by adhesive, ultra-sonic bonding or any other type of permanent attachment of a part to another part.

Advantages and effects provided by the second aspect of the disclosure are largely analogous to the advantages and effects as provided by the sealing arrangement according to the embodiments of the first aspect of the disclosure. It shall also be noted that all embodiments of the second aspect are applicable to and combinable with all embodiments of the first aspect of the disclosure and vice versa.

The object of the present disclosure is also at least partly achieved by the features of a tubular garment according to a third aspect of the disclosure. Hence, according to the third aspect of the disclosure, there is provided a tubular garment portion for a fluid-protective garment, having a first annular connection member extending circumferentially around the tubular garment portion, and configured to inter-connect to a second annular connection member of a second tubular garment portion, and a first annular seal member extending circumferentially around the tubular garment portion and adapted to form a fluid-tight seal configuration with a second annular seal member of the second tubular portion. Advantages and effects provided by the third aspect of the disclosure are largely analogous to the advantages and effects as provided by the embodiments of the first and second aspects of the disclosure. It shall also be noted that all embodiments of the first and second aspects are applicable to and combinable with all embodiments of the third aspect of the disclosure and vice versa. The disclosure also relates to the use of a reclosable sealing arrangement according to any one of the features, examples or variants mentioned above in respect to the first aspect, in a garment.

Further features of, and advantages with, the example embodiments will become apparent when studying the appended claims and the following description. The skilled person realize that different features of the example embodiments may be combined to create variants and example embodiments other than those described in the following, without departing from the scope of the present disclosure, as defined by the appended claims.

BRIEF DESCRIPTION OF THE DRAWINGS

With reference to the appended drawings, below follows a more detailed description of embodiments of the disclosure cited as examples.

DETAILED DESCRIPTION OF EXAMPLE EMBODIMENTS

Figure 1:
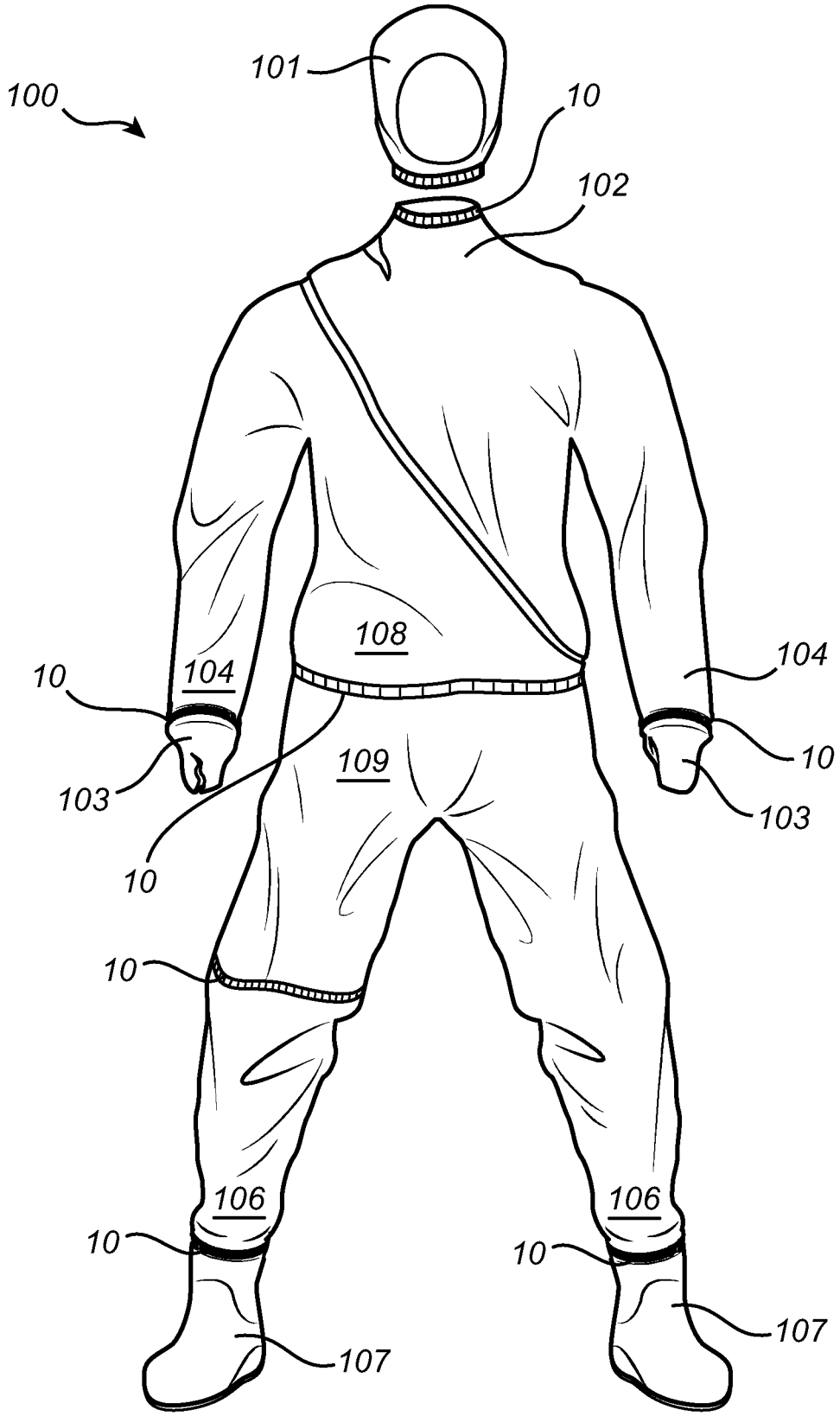
FIG. 1 schematically illustrates a garment for a wearer comprising a number of sealing arrangements according to an example embodiment of the disclosure; in which parts of the garments are sealingly connected to each other.

The present disclosure will now be described more fully hereinafter with reference to the accompanying drawings, in which exemplary embodiments of the disclosure are shown. The disclosure may, however, be embodied in many different forms and should not be construed as limited to the embodiment set forth herein; rather, these embodiments are provided for thoroughness and completeness. Like reference character refer to like elements throughout the description.

In FIG. 1 of the drawings an example embodiment of a garment 100 is schematically illustrated in an assembled state. FIG. 1 illustrates a garment 100, for instance a dry suit or a diving suit, comprising a number of sealing arrangements 10 according to any one of the example embodiments of the disclosure. The garment may likewise be a jacket, e.g. a rain jacket, and pants. As may be gleaned from FIG. 1, a neck portion 102, cuffs of the arms 104, wrists of the legs 106, and a waistline 108 are provided with such sealing arrangements 10. The neck portion 102 and the waistline portion 108 are typically provided with a relatively larger type of sealing arrangement as will be described in relation to any one of the example embodiments illustrated in FIGS. 2*a* to 6, while the cuffs of the arms 104 and the wrists 106 of the pants typically are provided with a sealing arrangement 10 of a relatively smaller size, as will be described in relation to any one of the example embodiments illustrated in relation to FIGS. 2*a* to 6.

For the neck portion 102, the sealing arrangement 10 may sealingly connect the neck portion 102 to a helmet 101 around its periphery. As such, the neck portion 102 is circumferentially and sealingly connected to the helmet 101 by means of the sealing arrangement 10, as will be further described in relation to any one of the example embodiments illustrated in FIGS. 2*a* to 6. Analogously, the waistline of an upper body part 108 of the dry suit (or a jacket of a work wear) and a waistline of a lower part 109 of the dry suit (or a pair of pants) are sealingly and connected to each other around its periphery by means of the sealing arrangement 10, as will be further described in relation to any one of the example embodiments illustrated in FIGS. 2*a* to 6. Analogously, the cuffs 104 of the arms of the dry suit and hand seals 103, or gloves, are sealingly connected to each other around its periphery by means of the sealing arrangement 10, as will be further described in relation to any one of the example embodiments illustrated in FIGS. 2*a* to 6. Analogously, a wrist 106 of the dry suit (or pants) and e.g. a boot 107 are sealingly connected to each other around its periphery by means the sealing arrangement 10, as will be further described in relation to any one of the example embodiments illustrated in FIGS. 2*a* to 6. Analogously, two portions of the pants, e.g. a lower portion of one leg portion and an upper portion of the leg portion may be sealingly and circumferentially connected to each other around its periphery via the sealing arrangement 10, as will be further described in relation to any one of the example embodiments illustrated in FIGS. 2*a* to 6. It is to be noted that the sealing arrangement can be used together with a wide range of different types of garment portions, especially with a wide range of differently sized annular garment portions. The above description may likewise be applicable to a garment comprising a jacket and a pair of pants. In other words, there is provided a garment, such as diving suit or dry suit having an outer garment formed from a plurality of tubular portions interconnected by one or several sealing arrangements to inhibit ingress of fluid, such as water, thereto.

With particular reference to FIGS. 2*a* to 6, there is depicted various example embodiments of a sealing arrangement 10 for use with the garment 100 in FIG. 1.

Figure 4:
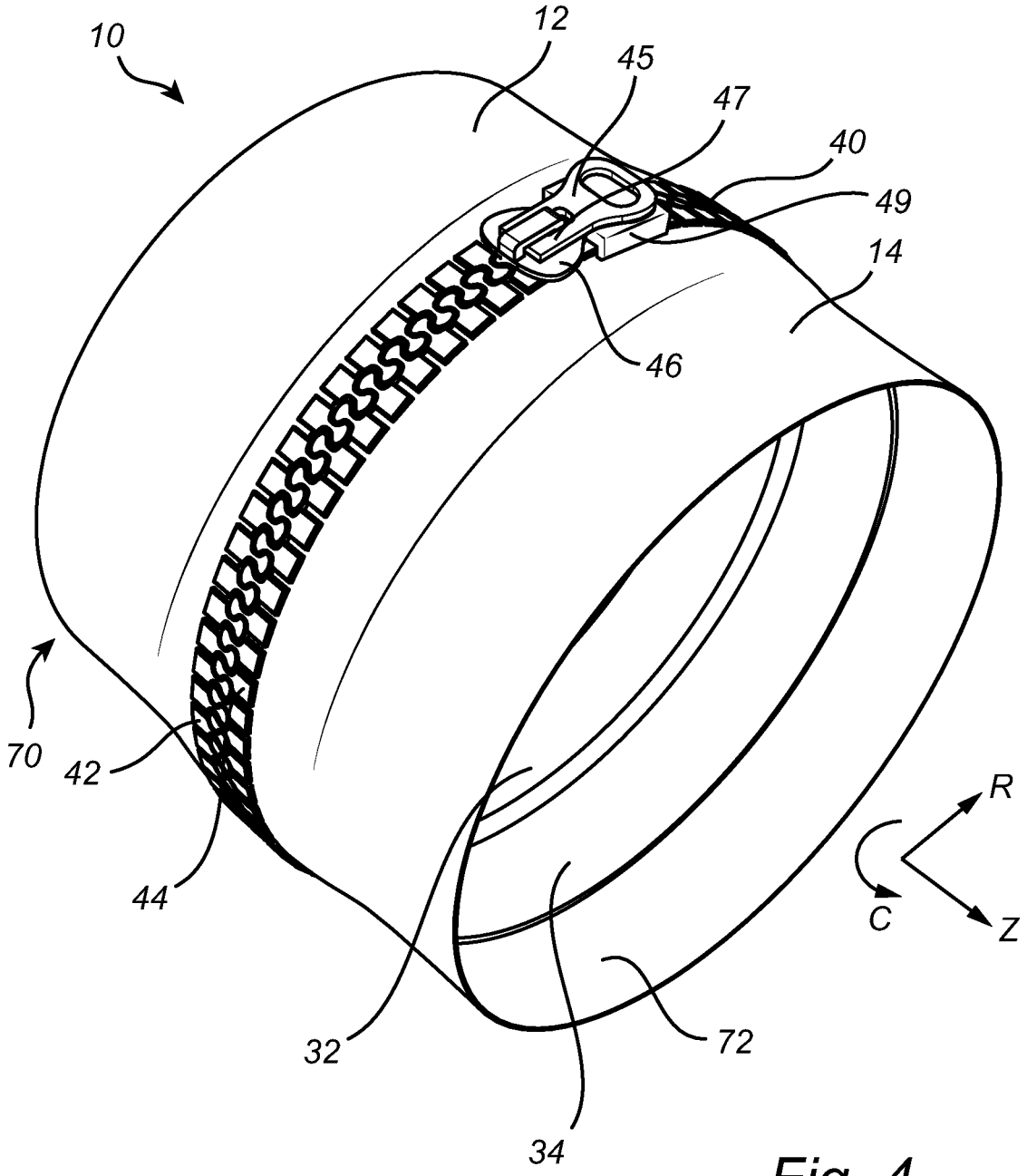
FIG. 4 shows a schematic illustration of a perspective view of the sealing arrangement in FIG. 3*d*, wherein the connection system is in an annularly closed configuration so as to maintain the annular seal members sealingly connected to each other.

As illustrated in the figures, e.g. FIG. 4, the sealing arrangement 10, and its related parts, have an extension in a circumferential direction C, i.e. in a direction around a periphery of the sealing arrangement 10, an extension in a radial direction R, i.e. in a direction perpendicular to the circumferential direction and directing from an inner surface 72 (see e.g. FIG. 4) towards an outer surface 70 (see FIG. 4). The inner surface 72 typically corresponds to an inside of the sealing arrangement 10, while the outer surface 70 typically corresponds to the outside of the sealing arrangement 10. In other words, the sealing arrangement 10 may be described with conventional cylindrical coordinates, the circumferential direction corresponding to the direction of the angle C of the angular coordinate C, the radial direction corresponding to a direction of the radial distance R, and the direction perpendicular to both the circumferential direction and the radial direction corresponding to a direction of the height Z. Hence, the sealing arrangement 10 has an extension in a height direction Z, that may sometimes be denoted as an axial direction of the sealing arrangement, and as also illustrated in FIG. 4.

It is to be noted that some components may be enlarged in relation to other components in order to facilitate the understanding of the example embodiments. Further, for ease of reference, the reclosable sealing arrangement may sometimes only be denoted as the sealing arrangement or simply as the arrangement.

Figure 3A:
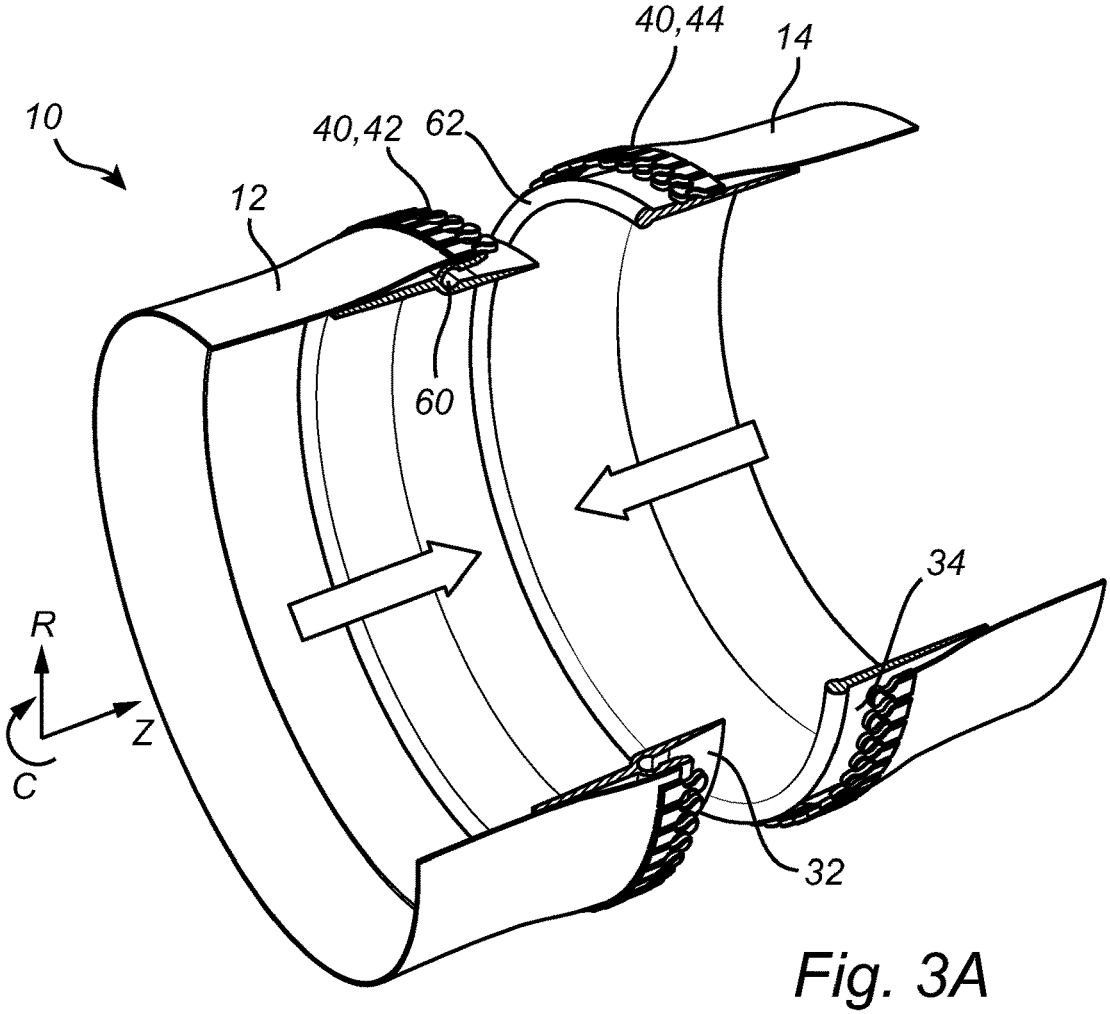
FIG. 3*a* shows a schematic illustration of a partly cross-sectional perspective view of the sealing arrangement according to example embodiments of the disclosure, when the parts of the sealing arrangement are in a released configuration relative each other, and which may reflect a first stage in the process of connecting the parts of the sealing arrangement to each other.
Figure 3B:
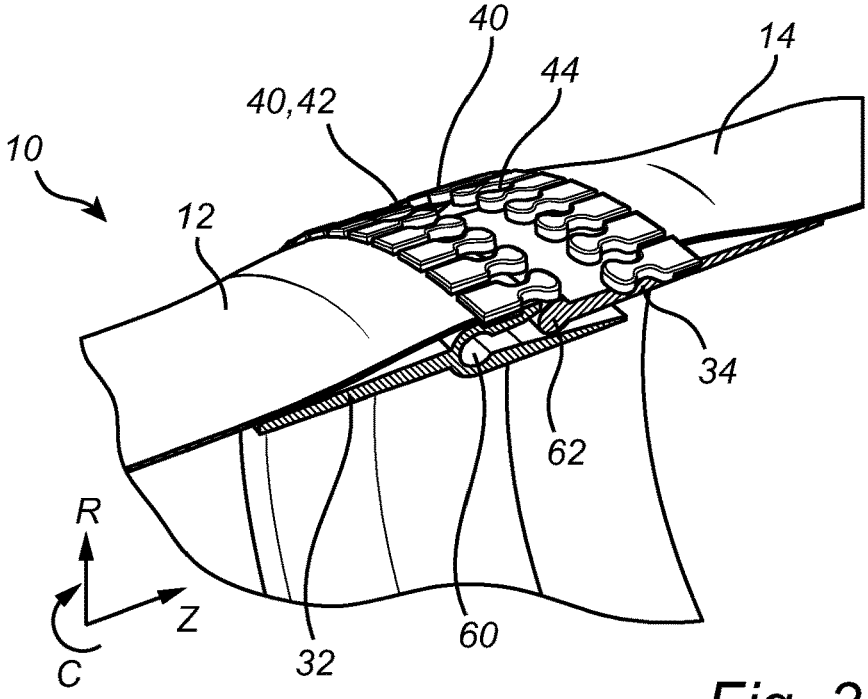
FIG. 3*b* shows a schematic illustration of a perspective view of the sealing arrangement according to the example embodiments of the disclosure, where an edge portion of one of the annular seal members is partly inserted into an edge portion of the other annular seal members, and which may reflect a second stage of the process of connecting the parts of the sealing arrangement to each other.

As illustrated in e.g. FIGS. 3*a* to 3*b* and FIG. 4, the sealing arrangement 10 is here defined by a first tubular portion 12 and a second tubular portion 14 for encircling a body portion of a user during use of the sealing arrangement in the garment 100 in FIG. 1. While the tubular portions 12 and 14 may be extensions of tubular portions of the garment, such as tubular portions of a dry suit, the sealing arrangement here comprises both the first tubular portion 12 for encircling a body portion of a user and the second tubular portion 14 for encircling the body portion of the user. By way of example, the first tubular portion 12 is adapted to encircle an arm of the user while the second tubular portion 14 is adapted to be a part of dry suit glove. The sealing arrangement 10 further comprises the outer circumferential surface 70 and the inner circumferential surface 72, as illustrated in e.g. FIG. 4. The outer circumferential surface 70 is facing away from the body portion (not shown) of the user during use of the sealing arrangement 10. The inner circumferential surface 72 is facing towards the user during use of the sealing arrangement 10.

In other words, the first tubular portion 12 and the second tubular portion 14 are separable portions relative each other. That is, the first tubular portion 12 and the second tubular portion 14 are disengagable from each other, as illustrated in e.g. FIG. 3*a*. Further, the first tubular portion 12 and the second tubular portion 14 are inter-connectable to each other to form a circumferential connection between the first tubular portion and the second tubular portion so as to provide a reclosable sealing arrangement. In order to inter-connect the first tubular portion 12 and the second tubular portion 14, the sealing arrangement 10 comprises a releasable connection system 40, as seen in the FIG. 4.

The releasable connection system 40 has a first annular connection member 42 extending circumferentially around the first tubular portion 12. In this example, the first annular connection member 42 is disposed circumferentially around the first tubular portion 12. Typically, although strictly not necessary, the first annular connection member 42 is arranged essentially completely around the first tubular portion 12.

The releasable connection system 40 also has a second annular connection member 44 extending circumferentially around the second tubular portion 14. In this example, the second annular connection member 44 is disposed circumferentially around the second tubular portion 14. Typically, although strictly not necessary, the second annular connection member 44 is arranged essentially completely around the second tubular portion 14.

When the sealing arrangement 10 is used around the body portion of the user, the releasable connection system 40 is here arranged along the outer circumferential surface 70 (see FIG. 4) of the sealing arrangement, thus facing away from the body portion (not shown) of the user during use. By means of the first annular connection member 42 and the second annular connection member 44, the releasable connection system 40 is configured to circumferentially interconnect the first tubular portion 12 with the second tubular portion 14.

As illustrated in the FIGS. 3*a* to 3*d* as well as in FIG. 4, the releasable connection system is here provided in the form of a zipper. Thus, the first annular connection member is here a first half of the zipper, while the second annular connection member is here a second half of the zipper. In the further description of the example embodiment of the sealing arrangement, the releasable connection system 40 will now be described with respect to a zipper, while the first and second annular connection members 42 and 44 will be described with respect to first and second halves of the zipper, respectively. Hence, the zipper may generally be referred to herein as the reclosable connection system 40.

In this example, the zipper 40 also comprises a slider 46, as illustrated in e.g. FIG. 4. The slider 46 is slidably coupled to the opposing zipper halves 42, 44. The slider is operable to releasably engage the opposing zipper halves 42 and 44 to each other. In this manner, the releasable connection system can be set in its connected state, as illustrated in e.g. FIG. 3*d*, which also will be further described hereinafter. By way of example, the first tubular portion 12 is provided with one half of the zipper 42, including the slider 46 and a so-called box 49, which is a common part of a conventional zipper arrangement. The slider 46 of the zipper also typically comprises an elongated tab member 45 having a first end 47 pivotally coupled to the slider 46.

The second tubular portion 14 is provided with a complementary half of the zipper 44 typically including an insert pin (not shown) of the zipper. Each half of the zipper further includes a stop (not shown) for the slider. The stopper is generally arranged at a circumferential end portion of each zipper halves. Accordingly, the zipper, including the zipper halves, typically extends from a circumferential starting point, typically defined by the box 49, to the circumferential end point, typically defined by the stopper. While the zipper generally extends around the circumferential extension of the sealing arrangement, i.e. 360 degrees in the circumferential direction, it should be readily appreciated that there may be a gap between the circumferential starting point of the zipper and the circumferential end point so as to provide circumferential space for the arrangement of the stopper and the box. In this context, the extension of the zipper, including the first and second zipper halves 42 and 44, should at least extend circumferentially around the sealing arrangement to provide a reliable circumferential inter-connection between the first and second tubular portions 12 and 14, i.e. to provide a connection that is capable of handling forces generated in the height direction Z of the sealing arrangement 10 during normal use thereof. Accordingly, it is to be noted that the zipper and its components are only schematically illustrated in the figures, and that the zipper may be provided in other ways as long as the first tubular portion 12 and the second tubular portion 14 can be inter-connected to each other and disengaged from each other by means of the zipper, i.e. the reclosable connection system.

To this end, the zipper with its two complementary halves allows the user to inter-connect and completely separate the first tubular portion 12 and the second tubular portion 14. By a reference to the above example with the arm and the glove of the garment 100 in FIG. 1, and if e.g. the first tubular portion 12 corresponds to a portion of the arm garment and the second tubular portion 14 is part of the glove, the reclosable sealing arrangement 10, once the glove is positioned onto the arm of the user, and when the zipper is closed, completely encircles the relevant portion of the arm (in this particular case the lower arm of the user), as can also be appreciated from the example embodiment depicted in e.g. FIG. 1 in combination with FIG. 4, illustrating the example embodiment on the arm of the user.

Moreover, as illustrated in e.g. FIGS. 3*a* to 3*d*, and also in FIG. 4, the sealing arrangement 10 comprises a first annular seal member 32. The first annular seal member 32 extends circumferentially around the first tubular portion 12. Analogously, the sealing arrangement 10 comprises a second annular seal member 34. The second annular seal member 34 extends circumferentially around the second tubular portion 14. By way of example, the first annular seal member 32 and the second annular seal member 34 are arranged on the inner circumferential surfaces of the first tubular portion 12 and the second tubular portion 14, respectively. Hence, in this example, the first and second annular seal members 32, 34 are arranged on the inner circumferential side 72 of the sealing arrangement. The first annular seal member and the second annular seal member are here made from a stretchable and watertight material selected from the group consisting of rubber, latex and silicon. Such materials not only provide flexible first and second annular seal members, but also impart some flexibility properties to the entire reclosable sealing arrangement.

As illustrated in e.g. FIG. 3*a* or FIG. 4, the first half 42 of the zipper and the first annular seal member 32 are disposed on radially opposite sides of the first tubular portion 12. Further, the second half 44 of the zipper and the second annular seal member 34 are disposed on corresponding radially opposite sides of the second tubular portion 14, respectively. Further, as shown in e.g. FIG. 3*d*, a portion of the first annular seal member 32 is arranged in contact with a portion of the second annular seal member 32 to form a fluid-tight seal configuration 30 when the first zipper half 42 (first annular connection member) is circumferentially connected to the other zipper half 44 (second annular connection member).

Figure 2A:
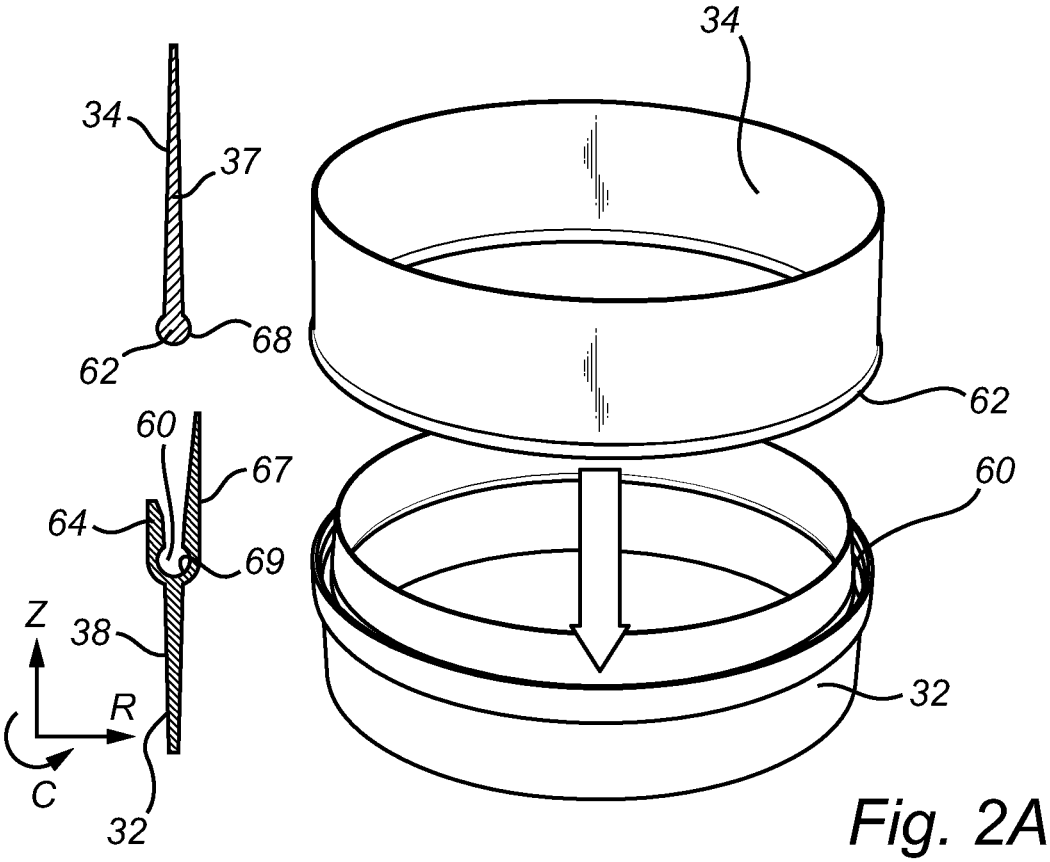
FIG. 2*a* shows a schematic illustration of a perspective view of parts of a sealing arrangement according to example embodiments of the disclosure, in which one annular seal member of the sealing arrangement is separated from another annular seal member of the sealing arrangement.
Figure 2B:
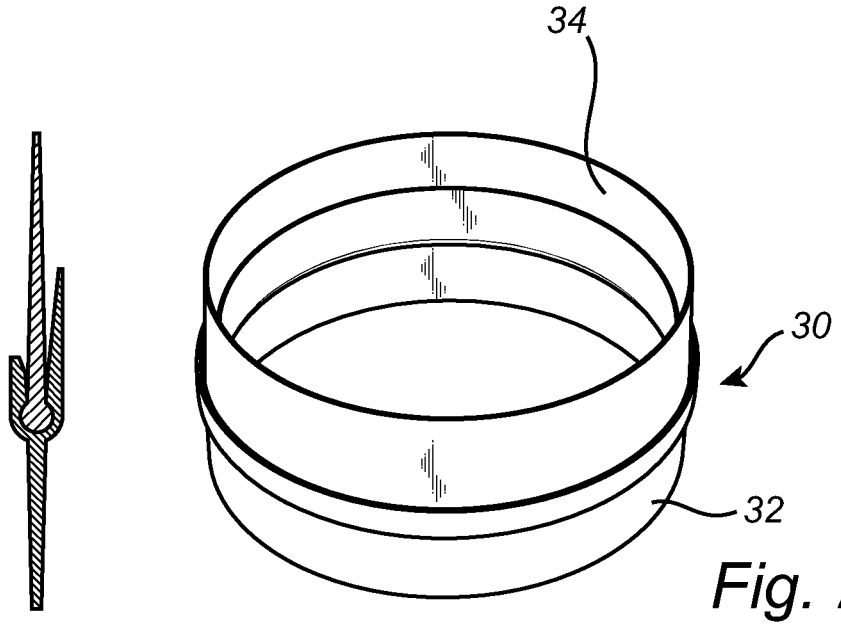
FIG. 2*b* shows a schematic illustration of a perspective view of parts of the sealing arrangement in FIG. 2*a* according to the example embodiments of the disclosure, in which the pair of annular seal members of the sealing arrangement are in contact with each other to form a fluid-tight seal configuration for a wearer of the garment.

Turning now to FIGS. 2*a* and 2*b*, illustrating the components of the fluid-tight seal configuration. More specifically, in FIG. 2*a*, the first annular seal member 32 and the second annular seal member 34 are illustrated in a non-sealing state, generally corresponding to a disengaged state relative each other. The first annular seal member 32 and the second annular seal member 34 are adapted to form the fluid-tight seal configuration 30 in a contacted state relative each other, as illustrated in e.g. FIG. 2*b*, which is obtained when the zipper 40 (reclosable connection system) is in its connected state (see e.g. FIG. 3*a*). The fluid-tight seal configuration is here arranged along the inner circumferential surface 72 facing the user during use of the sealing arrangement 10.

Further, as illustrated in FIGS. 2*a* and 2*b*, the first annular seal member 32 has an annular recess 60. In addition, the second annular seal member 34 comprises an annular rib portion 62. As shown in FIGS. 2*a* and 2*b*, and also in FIG. 3*b*, the annular recess 60 and the annular rib portion 62 are complementary shaped portions. The annular recess 60 is here arranged to accommodate the annular rib portion 62 when the first zipper half 42 (first annular connection member) is circumferentially inter-connected to the first zipper half 44 (second annular connection member).

In this manner, the first annular seal member 32 and the second annular seal member 34 are adapted to provide the fluid-tight seal configuration 30 for the releasable connection system 40 when the first annular connection member 42 is circumferentially connected to the second annular connection member 44. Such configuration of the sealing arrangement 10 is illustrated in e.g. FIG. 3*d* and FIG. 4. More specifically, when the first annular connection member 42 is circumferentially connected to the second annular connection member 44, the fluid-tight seal configuration 30 is provided over the connection between the first annular connection member 42 and the second annular connection member 44. That is, the first annular seal member 32 and the second annular seal member 34 cover the connection between the first annular connection member 42 and the second annular connection member 44 in the height direction Z and along the circumferential direction C, as partly illustrated in FIGS. 3*c* and 3*d*.

The annular recess 60 of the annular seal member can be defined in several different manners. In addition, the annular recess may be provided in several different shapes. In this example embodiment, the annular recess 60 resembles a truncated circle, as seen in a cross-sectional view defined by the radial direction R and the height direction H. The annular recess is here partly defined by an inner surface 69 of the first annular seal member 32. More specifically, the annular recess 60 is here defined by flanges 64 and 67 forming a truncated circular recess at their intersection with a stem portion 38. Accordingly, as shown in FIG. 2*a*, the first annular seal member 32 here comprises the stem portion 38 extending a substantial part in the height direction H and opposite extending flanges 64 and 67 thereof. A portion of each one of the opposite extending flanges 64 and 67 together defines parts of the truncated circular shape of the annular recess 60. Hence, the annular recess 60 is at least partly defined by the stem portion 38 and the flanges 64 and 69.

Analogously, as shown in FIG. 2*a*, the second annular seal member 34 comprises a stem portion 37 extending a substantial part in the height direction H. The annular rib portion 62 extends or projects from the stem portion 37 in the height direction H.

Typically, although not strictly required, each one of the stem portions are attached to the first and second tubular portions 12 and 14, respectively. In addition, or alternatively, each one of the stem portions may be attached to the first and second annular connection members 42 and 44, respectively.

Typically, although strictly not required, the inner surface 69 of the recess 60 contacts the outer surface 68 of the annular rib portion 62 to form the fluid-tight seal configuration when the first annular connection member 42 is circumferentially connected to the second annular connection member 44.

While the dimensions of the annular recess and the annular rib portion may vary for different types of sealing arrangement and garments, they typically extend along the entire annular length of the corresponding tubular portions 12 and 14, respectively. More specifically, the annular recess 60 extends the entire circumferential length of the first annular seal member 32. Analogously, the annular rib portion 62 extends the entire circumferential length of the second annular seal member 34.

Figure 5:
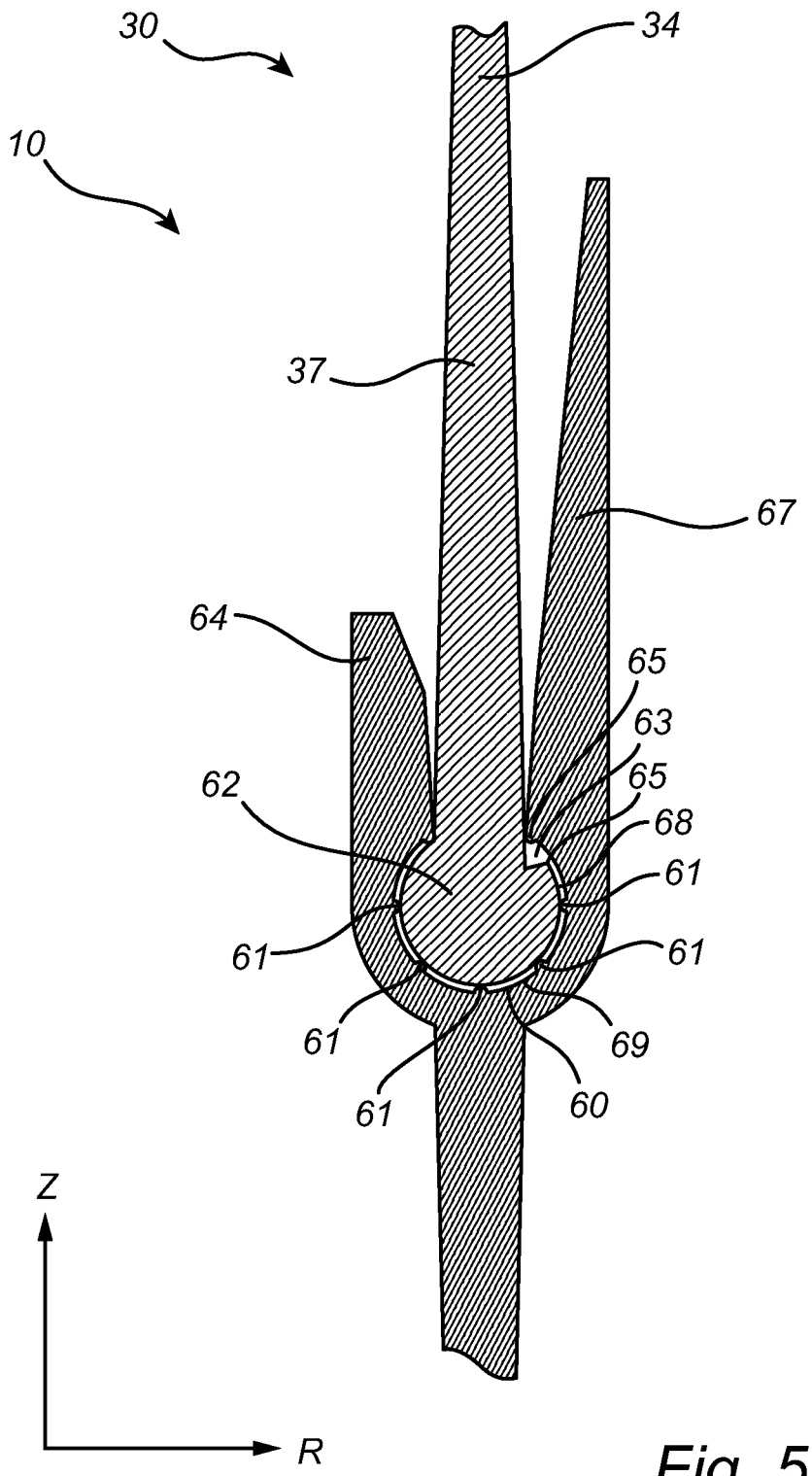
FIG. 5 schematically illustrates an enlarged side view of one example embodiment of an annular seal member of the sealing arrangement according to the disclosure, in which the annular seal member is fully inserted into the other annular seal member.

The design of the annular recess and the annular rib portion may also vary for different types of garments and use. FIG. 5 schematically illustrates one example embodiment of an annular seal member of the sealing arrangement according to the disclosure, in which the annular seal member is fully inserted into the other annular seal member. In this example, the annular portion 62 of the second annular seal member 34 has an indentation 63 for engaging with an edge 65 of the annular recess. The indentation is arranged to form a lip 65 or shoulder with an outer surface 68 of the annular portion 62.

Moreover, as shown in FIG. 5, the annular recess 60 has plurality of protrusions 61 distributed along the inner surface 69 of the recess 60. The protrusions 61 are arranged to engage with the corresponding outer surface 68 of the annular portion 62. As further illustrated in FIG. 5, the first annular seal member 32 comprises the opposite extending flanges 64 and 67 and the stem portion 34. As described in relation to the example in FIGS. 2*a* and 2*b*, the recess 60 is at least partly defined by the stem portion and the flanges. Accordingly, the first annular seal member 32 comprises the stem portion. Analogously, as illustrated in FIG. 5, the second annular seal member 34 comprises the stem portion 37. Typically, although not strictly required, each one of the stem portions are attached to the first and second tubular portions 12 and 14, respectively. In addition, or alternatively, each one of the stem portions are attached first and second annular connection members 42 and 44, respectively.

Now, with respect to FIGS. 3*a* to 3*d*, a sequence of connecting and sealing the tubular portions 12 and 14 of the sealing arrangement 10 around the circumferential direction C will be described.

In a disconnected state, represented by FIG. 3*a*, the first annular connection member 42 is completely separated from the second annular connection member 44, thus the first tubular portion 12 is disconnected from the second tubular portion 14. In order to connect the first tubular portion 12 to the second tubular portion 14, the tubular portions 12 and 14 are moved towards each other as indicated by the arrows in FIG. 3*a*.

Further, in FIG. 3*a*, there is also illustrated how the first and second annular connection members 42 and 44 (first and second halves of the zipper) are superposed arranged on the annular seal members 32 and 34, respectively. More specifically, the first annular connection member 42 is superposed the first annular seal member 32 in the radial direction R and the second annular connection member 44 is superposed arranged the second annular seal member 34 in the radial direction R.

Figure 3C:
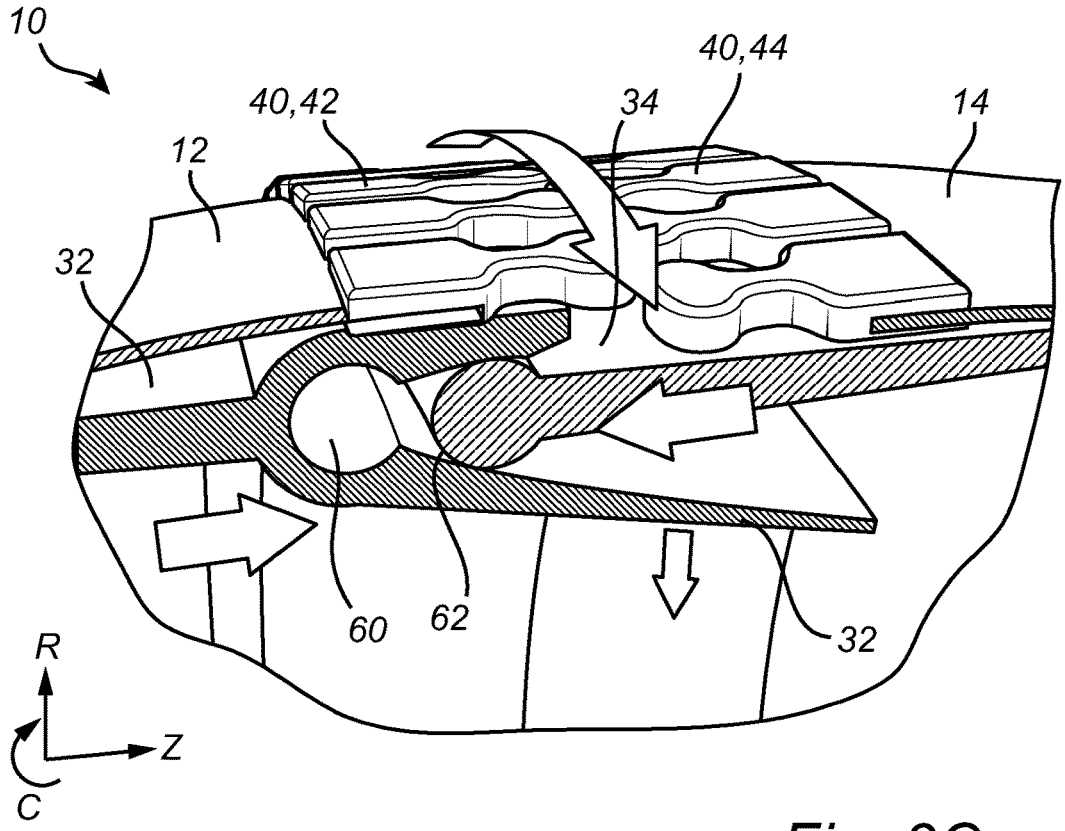
FIG. 3*c* is an enlarged cross-sectional perspective view of the sealing arrangement according to the example embodiments of the disclosure, where an edge portion of one of the annular seal members is further inserted into an edge portion of the other annular seal members, and which may reflect a third stage of the process of connecting the parts of the sealing arrangement to each other.
Figure 3D:
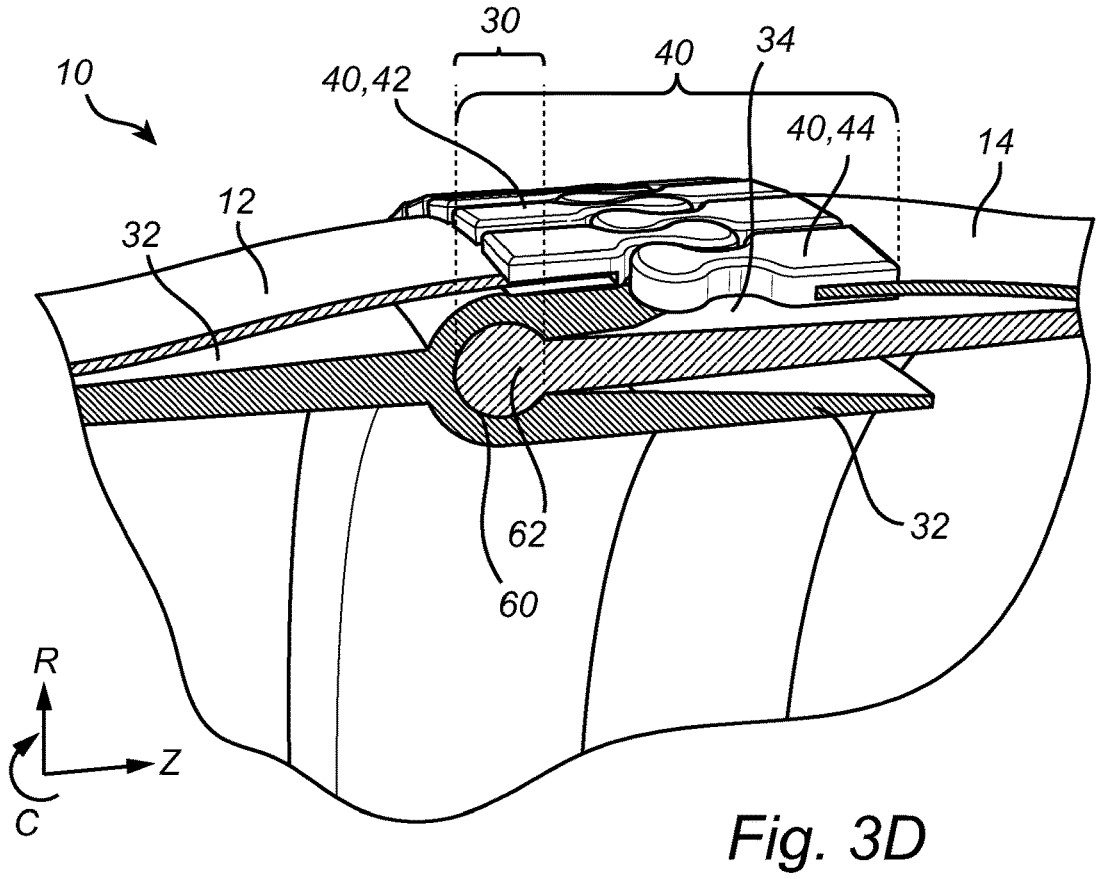
FIG. 3*d* is an enlarged cross-sectional perspective view of the sealing arrangement according to the example embodiments of the disclosure, where an edge portion of one of the annular seal members is fully inserted into an edge portion of the other annular seal members, and which forms a fourth and final stage of the process of connecting the parts of the sealing arrangement to each other; whereby the parts of the sealing arrangement are sealingly connected to each other to form a fluid-tight seal configuration for a wearer of the garment.

Next, the zipper 46 is operable to effect a circumferential closure and connection of the first and second halves of the zipper 42 and 44. Hence, while turning to FIG. 3*b*, the first and second annular connection members 42 and 44, i.e. the opposing zipper halves, are moved in contact with each other, corresponding to a relative movement of the zipper halves in the height direction Z, and the slider 46 of the zipper is operable to initiate an engagement or connection of the opposing zipper halves 42 and 44 to each other. The slider 46 is moved along the circumferential direction of the reclosable sealing arrangement. Simultaneously, or nearly simultaneously, the annular rib portion 62 of the second annular seal member 34 is moved towards the annular recess 60 of the first annular seal member 32, which is at least partly illustrated in FIG. 3*b*. While this sequence may be effected by the user itself, the additional positioning of the annular rib portion 62 of the second annular seal member 34 into the annular recess 60 of the first annular seal member 32, as partly illustrated in FIG. 3*c*, is generally smoothly effected by moving the elongate tab member 45 of the slider 46 of the zipper around the circumferential direction C of the arrangement until the slider 46 reaches a circumferential terminal end portion (i.e. the circumferential end point typically corresponding to the stopper of the zipper), whereby the first and second annular connection members 42 and 44, i.e. the opposing zipper halves, are set in the connected state. In the connected state of the sealing arrangement, the releasable connection system forms a mechanically connected configuration between the first tubular portion and the second tubular portion. The connected state of the releasable connection system 40, and thus the sealing arrangement 10, is illustrated in FIGS. 3*d* and 4. In this manner, the releasable connection system 40 is set in its connected state and the first annular seal member 32 and the second annular seal member 34 are positioned relative each other to form the fluid-tight seal configuration 30. More specifically, as illustrated in FIGS. 3*d* and 4, the annular rib portion 62 is accommodated in the annular recess 60 when the first and second annular connection members 42 and 44, i.e. the opposing zipper halves, are set in the connected state.

In other words, as described above in relation to FIGS. 3*a* to 3*d*, the first annular connection member 42 and the second annular connection member 44 are arranged relative the first annular seal member 32 and the second annular seal member 34, respectively, such that a closure of the releasable connection system 40 along the circumferential direction C brings the first annular seal member 32 and the second annular seal member 34 into the fluid-tight seal configuration 30. More specifically, as shown in e.g. FIG. 3*d*, the first half of the zipper 42 is arranged relative the annular recess 60 on the first annular seal member 32 and the second half of the zipper 44 is arranged relative the annular rib portion 62 on the second annular seal member 34, respectively, such that the annular recess 60 accommodates the annular rib portion 62 when the first half 42 of the zipper is circumferentially inter-connected to the second half 44 of the zipper.

Accordingly, when the first annular connection member (first zipper half) 42 and the second annular connection member (second zipper half) 44 are connected to each other, the releasable zipper connection system 40 extends in a continuous manner along the circumferential direction C of the sealing arrangement 10. In this manner, as illustrated in e.g. FIG. 4, the first annular connection member and the second annular connection member are adapted to connect to each other along the entire circumference of the sealing arrangement 10, while the first annular seal member 32 and the second annular seal member 34 are arranged to be sealed to each other along the entire circumference of the sealing arrangement 10 in order to seal a body part of the user from its surroundings.

Further, as may be gleaned from e.g. FIG. 3*d*, the first annular seal member 32 and the second annular seal member 34 are arranged in a partly overlapping fluid-tight seal configuration when the first annular connection member 32 is circumferentially inter-connected to the second annular connection member 34. That is, the first annular seal member and the second annular seal member overlap each other in the circumferential direction C as well as in the height direction Z. In this manner, the first annular seal member 32 and the second annular seal member 34 provides for preventing fluid such as water to enter to the body part of the user via the first and second annular connection members 42 and 44 of the releasable connection system 40.

The components of the sealing arrangement can be attached to each other in several different ways depending on the type of sealing arrangement and type of garment. In the example embodiments described in relation to FIGS. 2*a* to 2*b*, FIGS. 3*a* to 3*d*, FIG. 4 and FIG. 5, the first zipper half 42 (i.e. the first annular connection member) is attached to the first tubular portion 12 by means of adhesive, sewing or ultrasonic bonding. Analogously, the second zipper half 44 (i.e. the second annular connection member) is attached to the second tubular portion 14 by means of adhesive, sewing or ultrasonic bonding. The first annular seal member 32 may likewise be attached to the first tubular portion 12 by means of adhesive or ultrasonic bonding. Analogously, the second annular seal member 34 may also be attached to the second tubular portion 14 by means of adhesive or ultrasonic bonding. Further, in the example embodiments of the sealing arrangement, each one of the tubular portions may be provided by a layered material suitable for the garment, e.g. a waterproof material. In other example embodiments, each one of the tubular portions may be provided by the same material as the annular seal member materials, e.g. a flexible material, such as thermoplastic polyurethane (TPU), polyurethane, or rubber or silicone.

Moreover, while the example embodiments of the reclosable sealing arrangement have mainly been described in relation to a reclosable sealing arrangement comprising first and second tubular portions, it may also be possible that the first and second tubular portions of the sealing arrangement are defined by the annular connection members and the annular seal members. That is, the first tubular portion comprises the first annular connection member and the first annular seal member, while the second tubular portion comprises the second annular connection member and the second annular seal member. It may even be possible that each one of tubular portions consists of one annular connection member and one annular seal member. That is, in some example embodiments, although not explicitly illustrated, the first tubular portion is made of the first annular connection member and the first annular seal member, while the second tubular portion is made of the second annular connection member and the second annular seal member. In such example embodiments, the first annular connection member is directly attached to the first annular seal member without any additional intermediate layers of materials. Analogously, the second annular connection member is directly attached to the second annular seal member without any additional intermediate layers of materials. In such example embodiments of the sealing arrangement, the tubular portions of the sealing arrangement may then either extend into corresponding first and second tubular garment portions, respectively, or the tubular portions of the sealing arrangement may be attached to corresponding first and second tubular garments portions by e.g. adhesive or ultrasonic bonding.

Thus, in some example embodiments, the defined tubular portions of the sealing arrangement may be provided in the form of garment portions, such as an arm garment portion and a glove garment portion. The sealing arrangement according any one of the above additional example embodiments may include any one of the features, effects or functions as described in relation to the example embodiments in FIGS. 1 to 5.

Moreover, the reclosable connection system and the fluid-tight seal configuration may be arranged in a radial opposite configuration as illustrated in e.g. FIG. 4. That is, in another example embodiment (although not shown), the fluid-tight seal configuration may be arranged along the outer circumferential side of the reclosable sealing arrangement facing away from the body portion of the user during use of the reclosable sealing arrangement, while the releasable connection system is arranged along an inner circumferential side of the reclosable sealing arrangement facing the user during use of the reclosable sealing arrangement. The sealing arrangement according to this example embodiment may include any one of the features, effects or functions as described in relation to the example embodiments in FIGS. 1 to 5.

Figure 6:
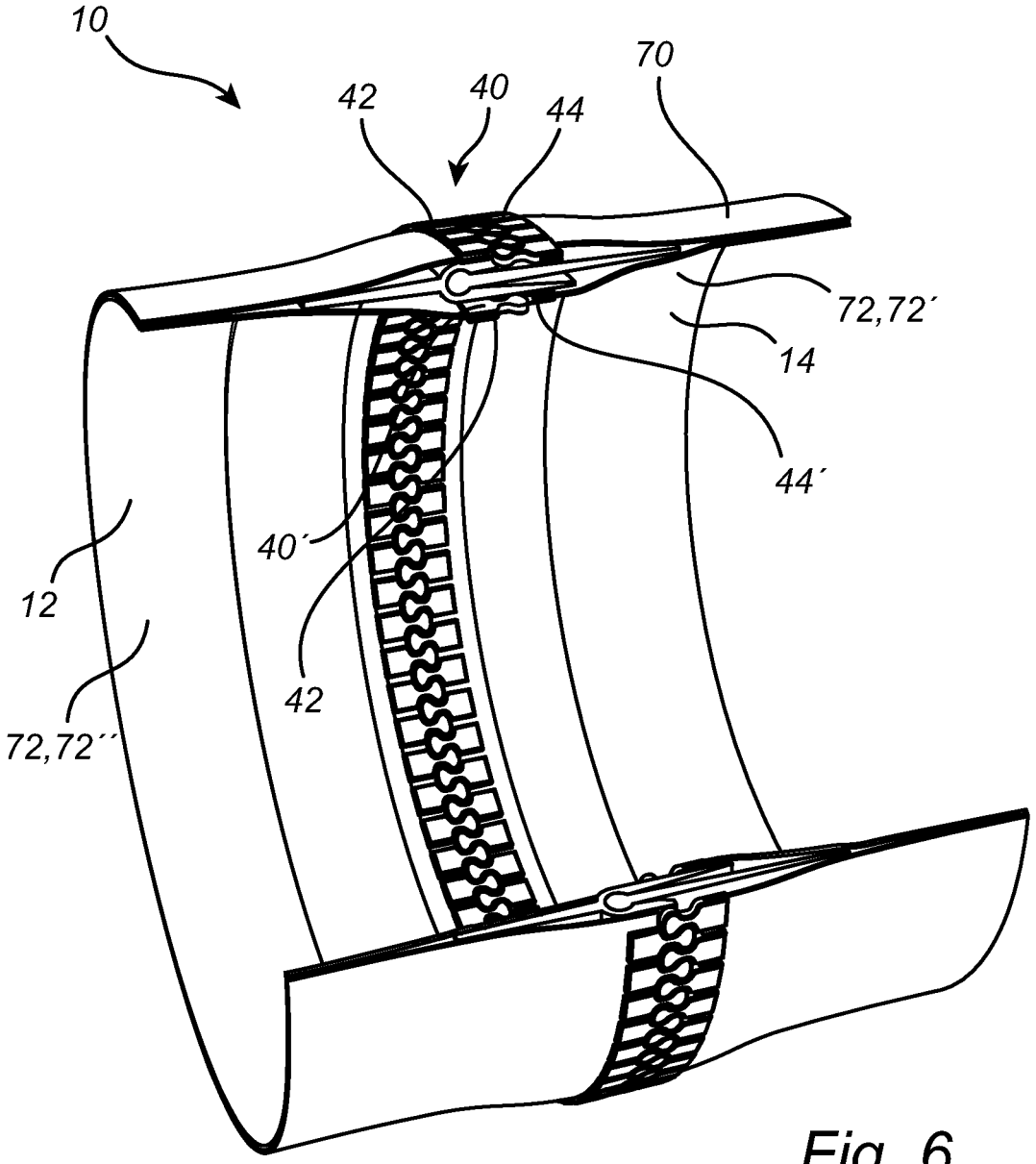
FIG. 6 schematically illustrates another example embodiment of a sealing arrangement according to the disclosure, in which sealing arrangement comprises a first annular releasable connection system and a second annular releasable connection system.

According to another example embodiment, as illustrated in FIG. 6, the sealing arrangement 10 includes a first releasable connector system 40 as the one described in relation to the FIGS. 1 to 5, and an additional releasable connector system 40' arranged on the inside 72 of the sealing arrangement. In other words, the sealing arrangement 10 here comprises the first releasable connection system 40 and further a second releasable connection system 40'. Typically, the first annular connection member 42 of the first releasable connection system 40 is arranged to the outer surface of the first tubular portion 12, while the second annular connection member 44 of the first releasable connection system 40 is arranged to the outer surface of the second tubular portion 14. Moreover, the second releasable connection system has a corresponding first annular connection member 42' disposed circumferentially around the inner surface 72' of the first tubular portion 12 and a corresponding second annular connection member 44' disposed circumferentially around the inner surface 72' of the second tubular portion 14. Moreover, the second releasable connection system 40' is configured to circumferentially connect the first tubular portion with the second tubular portion. Hence, the second releasable connection system 40' is arranged on the inner surface of the sealing arrangement. The second releasable connection system 40' may typically include any one of the features, functions and effects as described in relation to the releasable connection system 40.

As should be readily understood from the description with particular reference to FIGS. 1 to 6, each one of the tubular portions 12 and 14 of the sealing arrangement may include any one of the features, effects or functions as described in relation to the example embodiments herein. It is also possible to fabricate garments with the sealing arrangement 10 being an integral part therein. In such cases, the garment may basically comprise separable tubular portions as described above in relation to any one of the example embodiments of the figures.

Hence, thanks to the example embodiment as described above in relation to the FIGS. 1 to 6, it becomes possible to provide reliable and fluid-tight sealing configuration for a garment. In particular, in the example embodiments where the releasable connection system is provided in the form of a zipper, it becomes possible to decrease the force necessary to close the releasable connection system, and in turn the force needed to close the sealing arrangement about the body portion of the user. It should also be noted that the sealing arrangement as described in the example embodiments above may be specifically suited for an easy removal of one of the tubular portions from the other one of the tubular portions by means of the releasable connection system 40.

In other words, the disclosure is capable of modification in various obvious respects, all without departing from the scope of the appended claims. Accordingly, the drawings and the description are to be regarded as illustrative in nature, and not restrictive. Thus, reference signs mentioned in the claims should not be seen as limiting the extent of the matter protected by the claims, and their sole function is to make claims easier to understand.

Features illustrated in the different example sealing arrangements and example embodiments described above may be combined as understood by a person skilled in the art. Although the disclosure has been described with reference to example garments and sealing arrangement, many different alterations, modifications and the like will become apparent for those skilled in the art. For example, the sealing arrangement can be arranged at other annular garments sections and other shapes and orientations of the releasable connection systems and the annular seal members than presented herein are applicable. By way of example, the annular connection members may be provided by attracting magnetical materials so as to form a magnetically configured connection system. Further, the sealing arrangement may be used for other purposes than those explicitly mentioned here.

As used herein, the term "comprising" or "comprises" is open-ended, and includes one or more stated features, elements, steps, components or functions but does not preclude the presence or addition of one or more other features, elements, steps, components, functions or groups thereof. Similarly, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

The invention claimed is:

1. A reclosable sealing arrangement for a garment, the garment defining an inter-connectable first tubular portion and a second tubular portion for encircling a body portion of a user when worn, and comprising:

(i) a releasable connection system having:

a first annular connection member extending circumferentially around the first tubular portion, and a second annular connection member extending circumferentially around the second tubular portion, whereby the releasable connection system is configured to inter-connect said first tubular portion with said second tubular portion;

(ii) a first annular seal member extending circumferentially and continuously around an entire circumference of the first tubular portion; and (iii) a second annular seal member extending circumferentially and continuously around an entire circumference of the second tubular portion to form a fluid-tight seal configuration for the releasable connection system when said first annular connection member is interconnected to said second annular connection member, wherein the first annular seal member comprises an annular recess for accommodating an annular portion of the second annular seal member, whereby the fluid-tight configuration is formed when the annular recess accommodates the annular portion circumferentially around the sealing arrangement, wherein the annular portion is an outer edge portion of the second annular seal member, wherein the annular portion of the second annular seal member comprises: (i) a stem portion, and (ii) an annular rib portion extending from the stem portion, the annular rib portion having a greater cross-sectional thickness than the stem portion, wherein the annular recess of the first annular seal member and the annular rib portion of the second annular seal member are complementary shaped such that, when the annular rib portion is accommodated within the annular recess, an outer surface of the annular rib portion abuts or contacts an inner surface of the annular recess, wherein the first annular connection member and the second annular connection member comprise a first material, wherein the first annular seal member and the second annular seal member comprise a second material, the second material being different than the first material, wherein the first tubular portion and the second tubular portion each define an interior and an exterior, and wherein the releasable connection system is separate from the first and second annular seal members such that the releasable connection system is arranged on the exterior and the first and second annular seal members are arranged on the interior of the first and second tubular portions.

2. The reclosable sealing arrangement according to claim 1, wherein the first annular connection member and the second annular connection member are arranged relative the first annular seal member and the second annular seal member, respectively, such that inter-connecting said first annular connection member with said second annular connection member along a circumferential direction brings the first annular seal member in contact with the second annular seal member along the circumferential direction.

3. The reclosable sealing arrangement according to claim 1, wherein, when said first annular connection member is circumferentially inter-connected to said second annular connection member, the first annular seal member and the second annular seal member being arranged in a partly overlapping fluid-tight seal configuration.

4. The reclosable sealing arrangement according to claim 1, wherein the first annular connection member is at least partly superposed the first annular seal member in a radial direction and the second annular connection member is at least partly superposed the second annular seal member in the radial direction.

5. The reclosable sealing arrangement according to claim 1, wherein the releasable connection system is arranged along an outer circumferential side facing away from the body portion of the user during use of the reclosable sealing arrangement, and the fluid-tight seal configuration is arranged along an inner circumferential side facing the user during use of the reclosable sealing arrangement.

6. The reclosable sealing arrangement according to claim 1, wherein the first annular connection member is directly attached to the first annular seal member, and the second annular connection member is directly attached to the second annular seal member.

7. The reclosable sealing arrangement according to claim 1, wherein the releasable connection system is a zipper, the first annular connection member being a first half of said zipper and the second annular connection member being a second half of said zipper.

8. The reclosable sealing arrangement according to claim 7, wherein the first half of the zipper and the second half of the zipper are arranged relative the annular recess and the annular portion, respectively, such that the annular recess accommodates the annular portion when said first half of the zipper is circumferentially inter-connected to said second half of the zipper.

9. The reclosable sealing arrangement according to claim 1, wherein the releasable connection system is a magnetically configured connection system, wherein the first annular connection member comprises a first magnetic material and the second annular connection member comprises a second magnetic material, the first magnetic material and the second magnetic material being adapted to attract each other so as to form the releasable connection system.

10. The reclosable sealing arrangement according to claim 1, wherein the reclosable sealing arrangement is a flexible reclosable sealing arrangement, wherein at least the first and second annular seal members are first and second flexible annular seal members, respectively.

11. The reclosable sealing arrangement according to claim 1, wherein the releasable connection system is a first releasable connection system, and the sealing arrangement further comprises a second releasable connection system having corresponding first annular connection member and second annular connection member, said first releasable connection system and said second releasable connection system being arranged on radial opposite sides of the first and second annular seal members.

12. A fluid-protective garment, comprising a reclosable sealing arrangement according to claim 1.

13. The reclosable sealing arrangement according to claim 1, wherein the annular portion has an indentation for engaging with an edge of the annular recess.

14. The reclosable sealing arrangement according to claim 13, wherein the indentation is arranged to form a lip or shoulder with an outer surface of the annular portion.

15. The reclosable sealing arrangement according to claim 1, wherein the annular recess defines a plurality of protrusions distributed along a surface of the annular seal member defining the recess, said protrusions being arranged to engage with a corresponding outer surface of the annular portion.

16. The reclosable sealing arrangement according to claim 1, wherein the annular recess resembles a truncated circle, as seen in a cross-sectional view defined by a radial direction and a height direction.

17. A tubular garment portion for a fluid-protective garment, having a first annular connection member extending circumferentially around the tubular garment portion, and configured to inter-connect to a second annular connection member of a second tubular garment portion, and a first annular seal member extending circumferentially and continuously around an entire circumference of the tubular garment portion and adapted to form a fluid-tight seal configuration with a second annular seal member of the second tubular portion, the second annular seal member extending circumferentially and continuously around an entire circumference of the second tubular garment portion, wherein the tubular garment portion and the second tubular garment portion define an interior and an exterior, wherein the first annular connection member comprises a first material, wherein the first annular seal member comprises a second material, the second material being different than the first material, and wherein the first annular connection member is separate from the first and second annular seal members such that the first and second annular connection members are arranged on the exterior and the first and second annular seal members are arranged on the interior, wherein the first annular seal member comprises an annular recess for accommodating an annular portion of the second annular seal member, whereby the fluid-tight configuration is formed when the annular recess accommodates the annular portion circumferentially around the entire circumference, wherein the annular portion is an outer edge portion of the second annular seal member, wherein the annular portion of the second annular seal member comprises: (i) a stem portion, and (ii) an annular rib portion extending from the stem portion, the annular rib portion having a greater cross-sectional thickness than the stem portion, and wherein the annular recess of the first annular seal member and the annular rib portion of the second annular seal member are complementary shaped such that, when the annular rib portion is accommodated within the annular recess, an outer surface of the annular rib portion abuts or contacts an inner surface of the annular recess.

* * * * *